US010058751B2

(12) United States Patent
Filip

(10) Patent No.: US 10,058,751 B2
(45) Date of Patent: Aug. 28, 2018

(54) ACCESSORY ATTACHMENT SYSTEM FOR SPORTS EQUIPMENT BAGS

(71) Applicant: Romeo Filip, Gilbert, AZ (US)

(72) Inventor: Romeo Filip, Gilbert, AZ (US)

( * ) Notice: Subject to any disclaimer, the term of this patent is extended or adjusted under 35 U.S.C. 154(b) by 0 days.

(21) Appl. No.: 15/343,924

(22) Filed: Nov. 4, 2016

(65) Prior Publication Data

US 2017/0319920 A1 Nov. 9, 2017

Related U.S. Application Data

(63) Continuation-in-part of application No. 29/563,339, filed on May 4, 2016, which is a continuation-in-part of application No. 29/563,362, filed on May 4, 2016, which is a continuation-in-part of application No. 29/563,373, filed on May 4, 2016.

(51) Int. Cl.
*A63B 55/00* (2015.01)
*A63B 55/40* (2015.01)
*A63B 55/20* (2015.01)

(52) U.S. Cl.
CPC ..... *A63B 55/408* (2015.10); *A63B 55/20* (2015.10); *A63B 55/40* (2015.10)

(58) Field of Classification Search
CPC ..... A63B 55/408; A63B 44/20; A63B 55/40
USPC ..... 206/315.2, 315.5; 150/113; 190/110
See application file for complete search history.

(56) References Cited

U.S. PATENT DOCUMENTS 4,142,563 A * 3/1979 Ackerfeldt ..... A63B 55/00 206/315.5
4,282,912 A * 8/1981 Brown ..... A63B 55/00 206/315.5
4,895,198 A * 1/1990 Samuelson ..... A45C 1/00 150/111
5,628,443 A * 5/1997 Deutsch ..... A45C 7/0086 150/113
5,845,780 A * 12/1998 Allen ..... A45C 3/00 190/110
7,526,842 B2 * 5/2009 Wemmer ..... A41D 27/20 24/3.7
9,610,485 B2 * 4/2017 Lewter ..... A63B 55/50
2003/0230701 A1 * 12/2003 Chang ..... D04D 9/04 248/682
2005/0040059 A1 * 2/2005 Herold ..... A45C 7/0045 206/315.3
2006/0180624 A1 * 8/2006 Sadow ..... A45C 7/009 224/582
2007/0228097 A1 * 10/2007 Recanati ..... A45C 13/02 224/580
2007/0267454 A1 * 11/2007 Baiz ..... A45C 5/06 224/576
2008/0047639 A1 * 2/2008 Fox ..... A24F 13/22 150/160
2011/0309124 A1 * 12/2011 Dubois ..... A45F 3/04 224/628

(Continued)

*Primary Examiner* — Sue A Weaver
(74) *Attorney, Agent, or Firm* — Z IP Law PLLC; Claire Zopf

(57) ABSTRACT

An accessory attachment system referred to herein as the Accessorail System™ that provides for the attachment of one or more accessory bags, pouches, or cases to sports equipment bags and more particularly to that provides for the customization of a sports equipment bag only with the accessories desired and necessary.

14 Claims, 23 Drawing Sheets

(56) References Cited

U.S. PATENT DOCUMENTS

| | | | | |
|---|---|---|---|---|
| 2012/0048754 | A1* | 3/2012 | Niedermeier | A63B 55/00 206/315.3 |
| 2013/0092573 | A1* | 4/2013 | Pactanac | A63B 55/00 206/315.5 |
| 2014/0061075 | A1* | 3/2014 | Leposky | A63B 55/00 206/315.3 |
| 2016/0059096 | A1* | 3/2016 | Meyer | A63B 55/045 206/315.7 |
| 2017/0106257 | A1* | 4/2017 | Pactanac | A63B 55/40 |

* cited by examiner

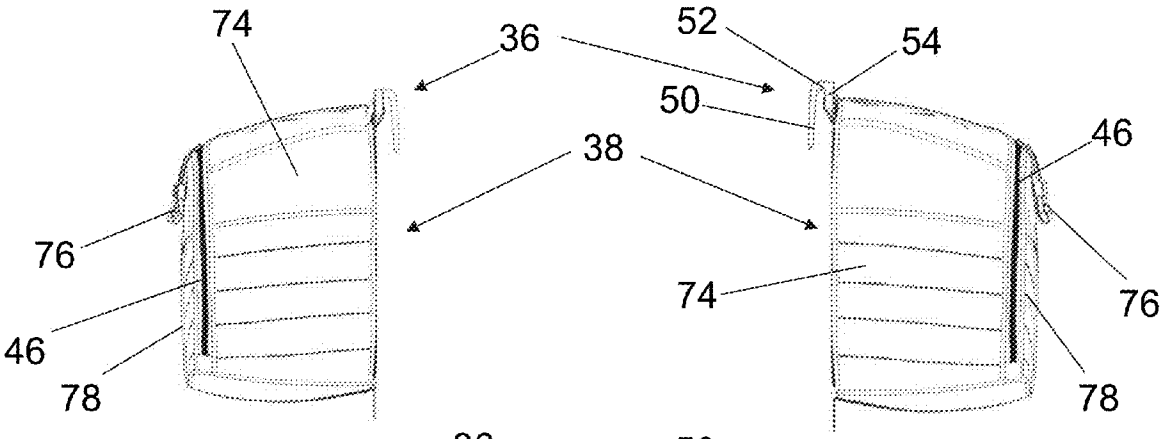
FIG. 5A
FIG. 5B
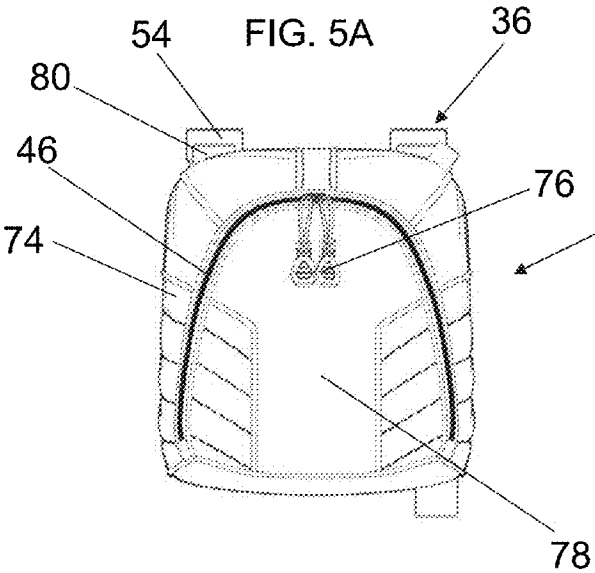
FIG. 5C
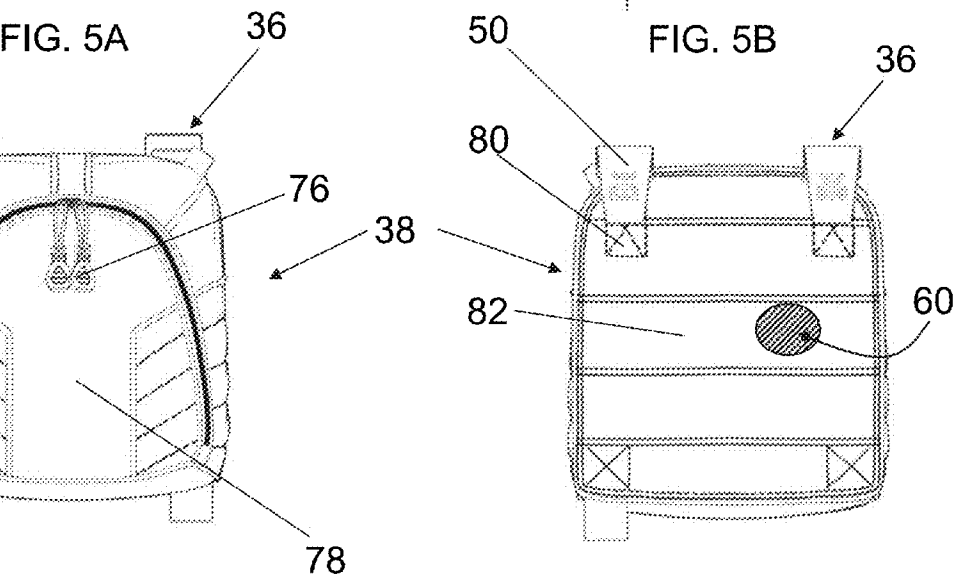
FIG. 5D

ACCESSORY ATTACHMENT SYSTEM FOR SPORTS EQUIPMENT BAGS

RELATED PATENT APPLICATIONS

This application claims the benefit of priority to U.S. Design patent application Ser. No. 29/563,339 filed May 4, 2016 entitled GOLF BAG, to U.S. Design patent application Ser. No. 29/563,362 filed May 4, 2016 entitled GOLF BAG, and to U.S. Design patent application Ser. No. 29/563,373 filed May 4, 2016 entitled GOLF BAG all of which are hereby incorporated herein by reference in their entireties.

FIELD OF THE INVENTION

The present invention is related to an accessory attachment system referred to herein as the Accessorail System™ that provides for the attachment of one or more accessory bags, pouches, or cases to sports equipment bags and more particularly to an accessory attachment system that provides for the customization of a sports equipment bag only with the accessories desired and necessary.

BACKGROUND OF THE INVENTION

The use of equipment bags carrying clubs, bats, balls, shoes, garments and other items is prevalent in many sports. However, commonly a bag having only a single compartment may quickly become disorganized as items are haphazardly placed within the compartment. For more elaborate bags, items become placed within a section, compartment or pocket and then must be carried with the bag regardless if the items are needed or will be used. For example, a heavy garment may be a necessity on a windy day, but once placed in the bag, it remains and is carried even when not needed on a hot, sunny day.

In a game requiring special equipment and accessories such as the game of golf, different types of bags may be available depending on the needs of the golfer, the type of course that is being played, and the transportation method for getting around the golf course. If a golfer is using a golf cart, then little thought may be given to what and how much is included within their golf bag and the golfer may have a large cart bag that has several pockets for accessories. The large, heavy golf bag is not optimal for carrying long distances and must only be lifted to and from the golf cart or be placed onto a hand cart to transport around the golf course. If the golfer is carrying their golf bag, they may use a stand bag that includes legs to support the bag and that is smaller and more maneuverable than a cart bag. The smaller stand bag has some pouches and pockets for accessories, and often has a larger shoulder strap that may be placed over one or both shoulders, to carry the golf bag. For professional golfers that use a caddy, a staff or tour bag that is larger than a stand bag and usually heavier is designed to hold a full 14 club-set and all necessary accessories. If the golfer is walking, then a lightweight carry or weekend bag may be used that holds only a basic set of clubs, balls and tees, and often has a minimum number of sections or pockets so that the golfer is not weighed down with unnecessary equipment within the carry bag. However, if certain accessories are needed, there is no available place within the carry bag to hold the accessory item.

Any of these different types of golf bags or other bags used for sporting equipment may have built in sections, pockets, and compartments that provide for a user to store items that might be needed which often results in a user carrying more than they need. Often it may be important to only carry the necessary items such as when rock climbing, camping or hiking where back packs and camping bags may be carried long distances. Gym and work out bags, baseball equipment bags and others may quickly become disorganized and time may be spent trying to find items that have been placed in a disorganized way with these type bags. The present invention provides for the attachment and removal of accessory bags, pouches, cases and other storage compartments to allow a user to more effectively organize items, and easily remove the accessory storage compartments that contain items that are not necessary for the activity being performed.

SUMMARY OF THE INVENTION

The present invention is related to sports equipment bags and an accessory attachment system, the Accessorail System™ that provides for the attachment of Accessorail System accessories such as bags, cases and pouches of various sizes and purposes to be attached to the sports equipment bag. The Accessorail System accessories provide for clean and attractive organization of items using properly shaped, sized and secure pockets and pouches to in some embodiments fit a specific purpose and address a specific need. The Accessorail System is unique in that it provides for the sports enthusiast to mix and match the Accessorail System accessories to tailor an Accessorail System sports equipment bag to have only the items they need at the time when they need them and not be carrying the additional weight or risk the security of items that are not immediately needed. The Accessorail System is adaptable and usable with many different types of sports equipment bags, such as golf bags, baseball equipment bags, rock climbing, camping or hiking bags and back packs, gym and work out bags and others. The Accessorail System provides a very different accessory attachment system from any other storage system currently available for sports equipment and uniquely provides for accessory items to be added and be securely affixed to the bag when needed or be easily removed when not needed.

The Accessorail System Accessories may include cigar holders, cooler pockets, flask pockets, golf ball holders, garment or apparel accessory bags, accessory pouches of various sizes and shape, rangefinder cases, speaker pockets, sunglass cases, tablet pockets, valuables pockets, watch cases and water packs. Any and all of which may have an assortment of zippers, snaps, fasteners, locking mechanisms, and straps. The Accessorail System accessories may also have one or more compartments such as pockets and pouches and include the Accessorail System fasteners for attachment to a sports equipment bag.

Some of the Accessorail System accessories are not commonly available for example, with golf or gym bags, which while they normally may have pockets and compartments, these do not specifically provide for proper storage of breakable or easily damaged items like the Accessorail System cigar, range finder, watch or sunglass cases and few if any can protect and properly secure a computer tablet. The Accessorail System tablet pouch is perfectly shaped and of an appropriate size to store a computer tablet in a much more desirable manner than simply placing the tablet in the bottom of a bag to have it damaged while carrying or when placing items in or taking items out of the bag. Additionally, the Accessorail System speaker pockets provide music in any location using a wireless Bluetooth speaker system, a common necessity when working out. The Accessorail System cooler pockets or water pack also maintain food or drinks at cool temperature, something that very often the pockets and compartments of sports equipment bags do not offer.

It is an object and advantage of the present invention to have accessories configured to be removably attached to a sports equipment bag.

It is an object and advantage of the present invention that an attachment panel attached to a sports equipment bag have reinforced layered rails that include at least one slit configured to removably attach an accessory to the sports equipment bag by having an attachment fixture of the accessory inserted into the slit.

It is an object and advantage of the present invention that an attachment panel affixed to a sports equipment bag be covered with a hook and loop fastener and a surface of an accessory be covered with a mating hook and loop fastener to removably attach an accessory to a sports equipment bag.

The present invention is related to an accessory attachment system comprising at least one attachment fixture attached to an accessory of a sports equipment bag; an attachment panel having a plurality of slits configured to accept the at least one attachment fixture, the attachment panel affixed to a surface of a sports equipment bag; and wherein the accessory may be removably attached to the sports equipment bag by inserting the attachment fixture into the slit of the attachment panel. The accessory attachment system may comprise an alignment of the plurality of slits along a rail of reinforced fabric affixed to the attachment panel and the alignment of the plurality slits may extend perpendicular to the rail of reinforced fabric affixed to the attachment panel. The accessory attachment system may comprise an accessory selected from a group consisting of a cigar holder, a cooler pocket, a flask pocket, a golf ball holder, an apparel bag, a pouch, a rangefinder case, a speaker pocket, a sunglass case, a tablet pocket, a valuables pocket, a watch case and a water pack. The attachment fixture of the accessory attachment system may comprise a J-hook configured to be inserted in one of the plurality of slits. The J-hook may comprise a tapered flattened extender extending from a top portion that extends from a back frame with a minimal distance between the extender and back frame to provide for a surface of the accessory adjacent to the attachment panel to lay flat against the attachment panel. The back frame of the J-hook may comprise a cross bar forming an opening configure to accept a strap attached to an accessory. The attachment panel of the accessory attachment system may comprise an outer surface covered with a hook and loop fastener and the accessory may comprise an outer surface covered with a mating hook and loop fastener for attachment to the attachment panel comprising an outer surface covered with a hook and loop fastener. The attachment panel of the accessory attachment system may be configured to attach a plurality of accessories. The sports equipment bag of the accessory attachment system may be a golf bag, a gym bag, a baseball equipment bag or a back pack.

The present invention is also related to a golf bag having detachable accessories, comprising at least one attachment fixture attached to an accessory of a golf bag; an attachment panel having a plurality of slits configured to accept the at least one attachment fixture, the attachment panel affixed to a surface of a golf bag; and wherein an accessory may be removably attached to the golf bag using the attachment fixture and attachment panel. The attachment fixture of the golf bag having detachable accessories may comprise a J-hook configured to be inserted in one of the plurality of slits. The attachment panel may comprise an outer surface covered with a hook and loop fastener and the accessory may comprise an outer surface covered with a mating hook and loop fastener for attachment to the attachment panel comprising an outer surface covered with the hook and loop fastener.

The present invention is also related to a method of removably attaching an accessory to a sports equipment bag comprising affixing an attachment panel to a surface of a sports equipment bag; forming slits in a layered portion of the attachment panel; removably attaching an accessory having an attachment fixture to the sports equipment bag by inserting the attachment fixture into the slits of the attachment panel. The method of removably attaching an accessory to a sports equipment bag may comprise covering the outer surface of the attachment panel with a hook and loop fastener; covering a surface of the accessory with a mating hook and loop fastener; and removably securing the surface of the accessory to the attachment panel using the hook and loop fastener.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which:

FIG. 5A is a right-side elevation view of an embodiment of an Accessorail System accessory pouch of the present invention;

FIG. 5B is a left-side elevation view of an embodiment of the Accessorail System accessory pouch of the present invention;

FIG. 5C is a front elevation view of an embodiment of the Accessorail System accessory pouch of the present invention;

FIG. 5D is a rear elevation view of an embodiment of the Accessorail System accessory pouch of the present invention;

DETAILED DESCRIPTION OF THE DRAWINGS

Figure 1B:
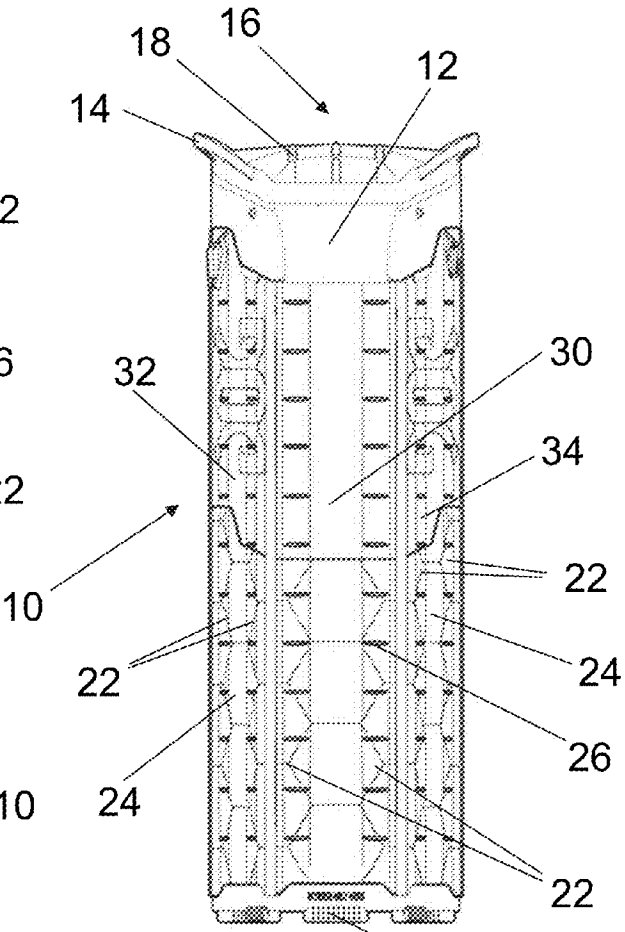
FIG. 1B is a front elevation view of an embodiment of a cart bag in an embodiment of the present invention.
Figure 1A:
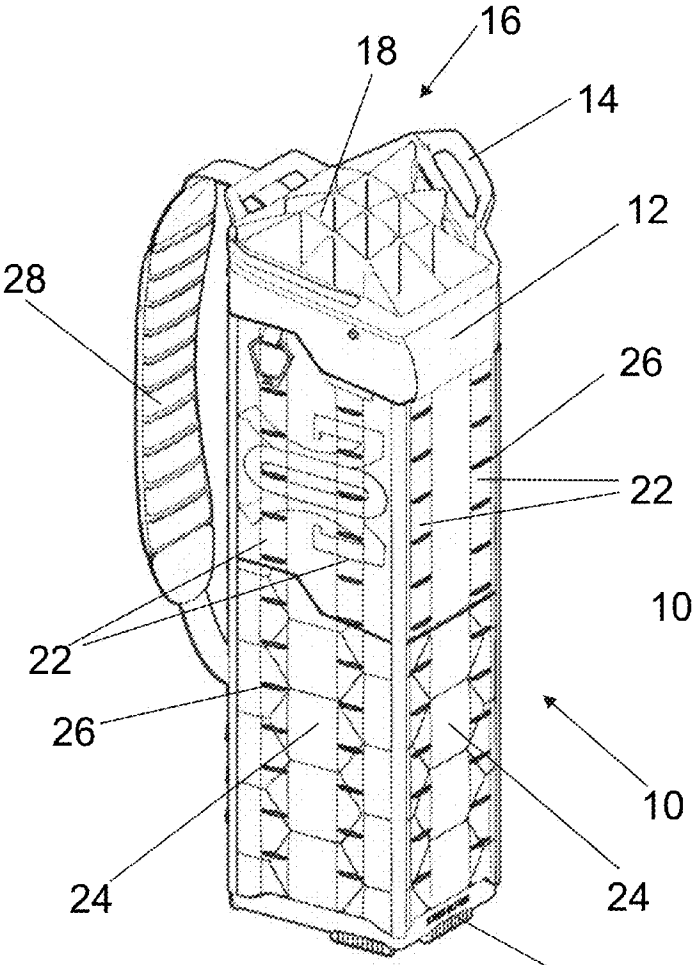
FIG. 1A is a perspective view of an embodiment of a cart bag in an embodiment of the present invention.

In an embodiment of the invention as shown in FIG. 1A, the Accessorail System 10 is incorporated with an Accessorail System cart golf bag 12 and with other types of golf bags as described herein. As noted above a cart bag is a larger sized golf bag that has a number of pockets and compartments which usually includes one or more pouches, various pockets along the sides and commonly an apparel accessory bag. The Accessorail System cart bag 12 is very different from the golf bags of the prior art in that the while the cart bag 12 provides handles 14 at the top to lift or pull the cart bag 12, a club compartment 16 with separators 18 that extends the length of the cart bag 12, and sturdy base supports 20 that hold the cart bag upright, the Accessorail System cart bag 12 has no accessory pockets or pouches. Instead along the length of one or more sides of the cart bag 12, Accessorail System rails 22 are provided along an Accessorail System panel 24 for the attachment of Accessorail System Accessories. The Accessorail System golf bags are made from lightweight durable materials such as a plastic composites, leather, Kevlar, nylon, canvas, carbon fiber, and/or other sturdy fabrics and materials to support and protect a player's golf clubs, personal items, and other sporting equipment. Each Accessorail System rail 22 is formed as a second layer of material sewn or otherwise attached to the Accessorail System panel 24. The second layer of material may be attached to the front rear of the Accessorail System panel 24 and be of a strong resilient material such as Kevlar, or nylon. The Accessorail System rail 22 has a series of slits 26 that may be formed by cutting through the additional layer of the Accessorail System rail 22 and folding over material or otherwise reinforcing material at the slit 26 by adding additional material layers, using buttonhole stitching around the slit 26, or using other methods known in the art to form the slit 26 as a smooth opening that will not tear or separate within the Accessorail System rail 22. The slits 26 are arranged to each extend perpendicular to the Accessorail System rail 22 that extends along all or a portion of the Accessorail System panel 24. A removable strap 28 may be attached to the Accessorail System cart bag 12 for carrying and lifting. As shown in an elevation view in FIG. 1B, a front panel 30 having the Accessorail System 10 may be of a narrower width than the similarly dimensioned left side panel 32 and right side panel 34 giving the overall appearance of the Accessorail System cart bag 12 a unique, sleek design.

Figure 2B:
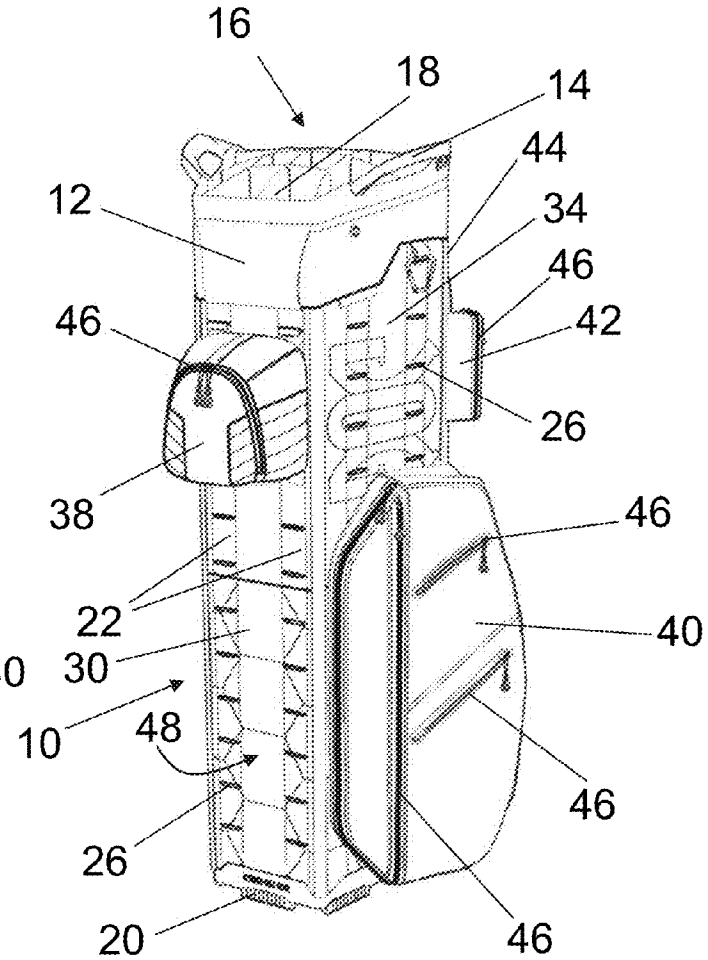
FIG. 2B is a perspective view of an embodiment of a cart bag and embodiments of accessories in an embodiment of the present invention.
Figure 2A:
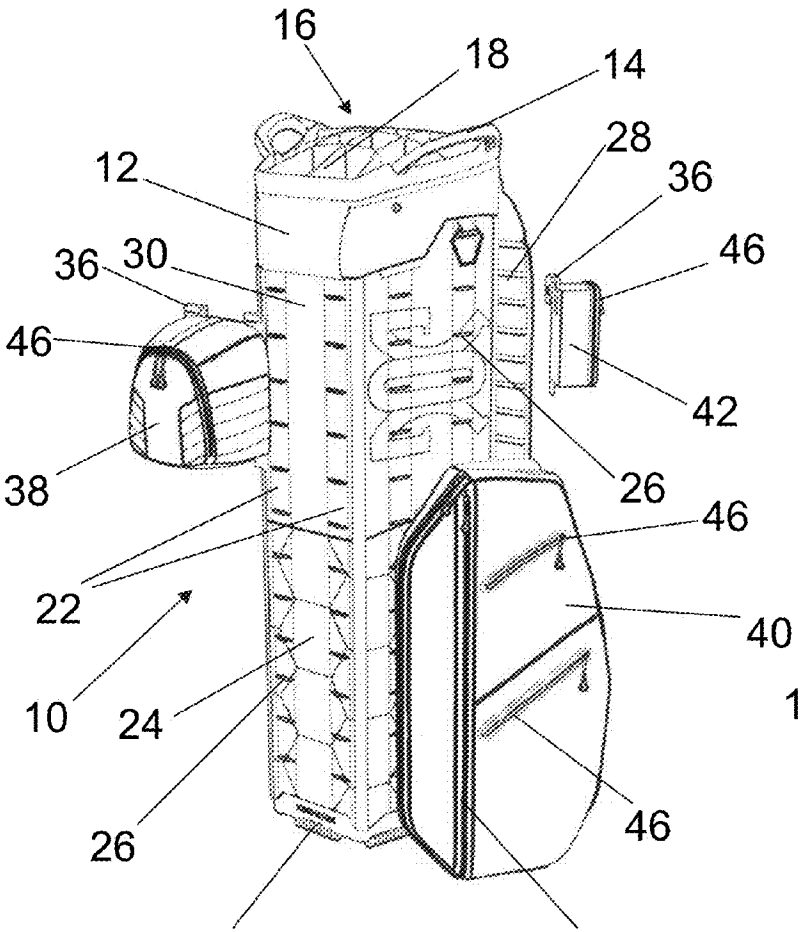
FIG. 2A is an assembly view of an embodiment of a cart bag and embodiments of accessories in an embodiment of the present invention.

As shown in FIG. 2A, each Accessorail System accessory has J-hooks 36 affixed to the accessory to provide for the J-hooks 36 to be aligned with and be slid into one or more slits 26 to attach the accessory to the Accessorail System panel 24 of the cart bag 12. For example, a small accessory pouch 38 having two J-hooks 36 may be aligned along the Accessorail System panel 24 on the front side 30 of the cart bag 12 and be attached by sliding the J-hooks 36 into a pair of slits 26 in the upper portion of the rails 22, an apparel bag 40 having J-hooks 36 may be aligned along the right side 34 of the cart bag 12 and be attached by sliding the J-hooks 36 into a pair of slits 26 in the mid-section of the rails 22 and a sunglass case 42 having a J-hook 36 may be aligned along a rear side 44 of the cart bag 12 and be attached to a slit 26 along an upper portion of a rail 22 to have all three Accessorail System accessories be attached and accessible with the Accessorail System cart bag 12, as shown in FIG. 2B. The Accessorail System accessories as bags, pouches, cases and other containers may have pockets and compartments to organize items and have one or more zippers, snaps or other fasteners 46 or locking mechanism to secure items and prevent movement or damage to items as the Accessorail System cart bag 12 is being carried or otherwise transported during and after play.

Figure 3B:
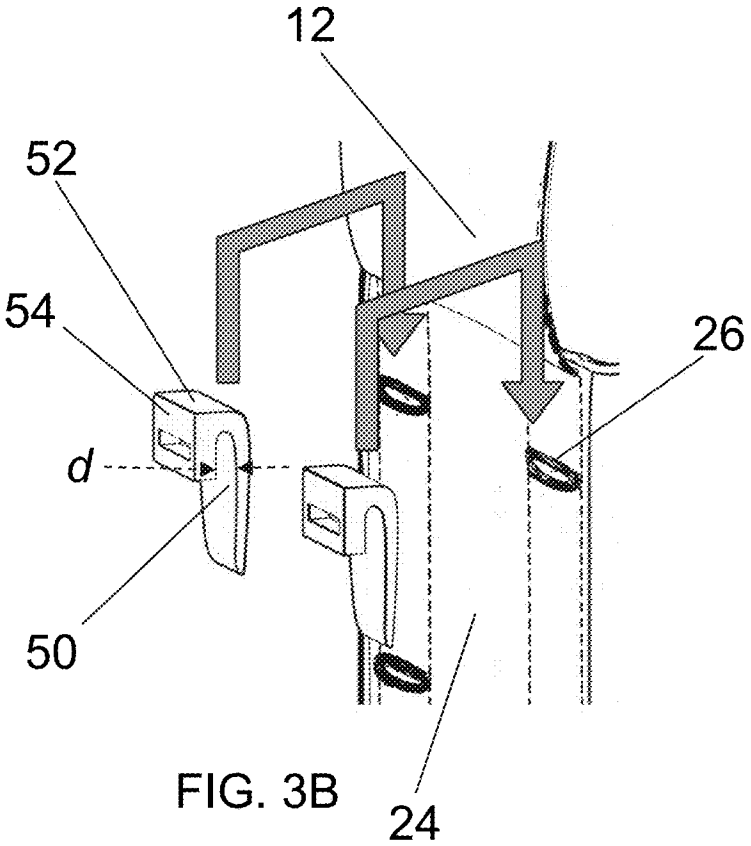
FIG. 3B is an assembly view of an embodiment of the Accessorail System panel and J-hooks in an embodiment of the present invention.
Figure 3A:
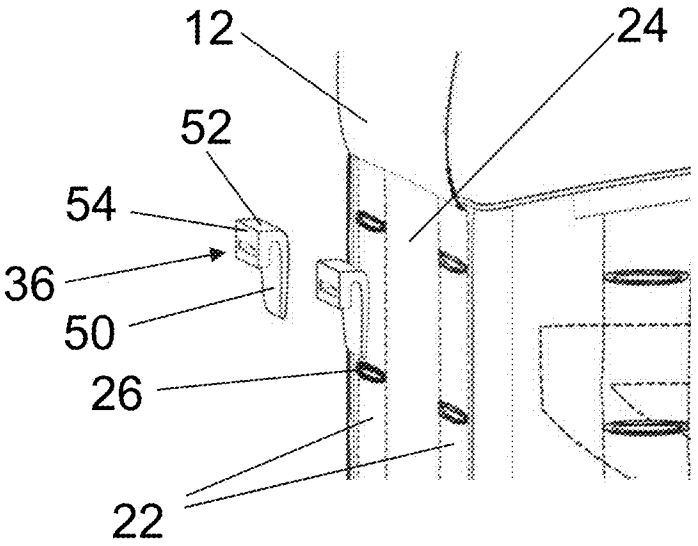
FIG. 3A is an assembly view of an embodiment of the Accessorail System J-hooks and Accessorail System in an embodiment of the present invention.
Figure 3C:
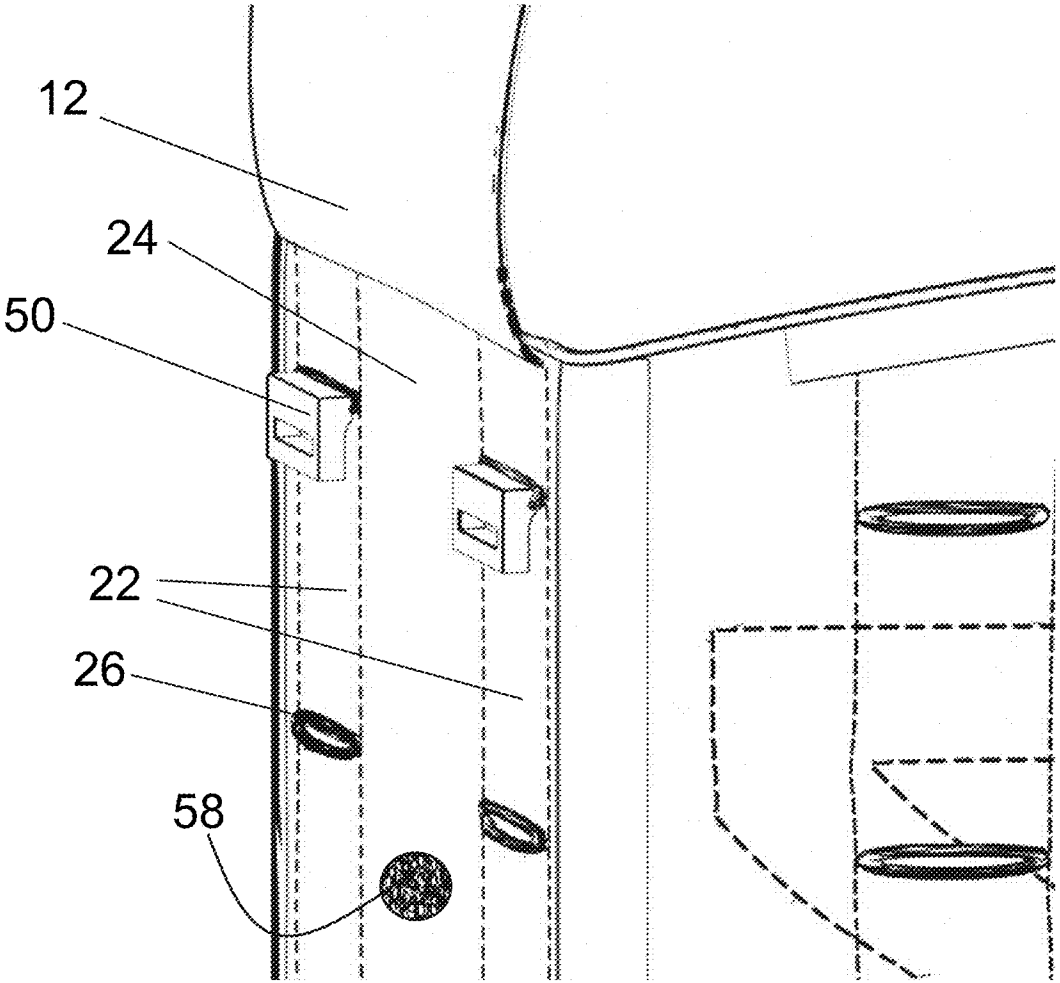
FIG. 3C is a perspective view of an embodiment of the Accessorail System panel and J-hooks in an embodiment of the present invention.

As shown in FIG. 3A, the Accessorail System J-hooks 36 have a flattened extender portion 50 that may be tapered to easily slide the extender portion 50 into a slit 26 along the Accessorail System rails 22. The extender 50 depends from a top portion 52 which extends a minimal distance d from a back frame 54 as shown in FIG. 3B that provides for the J-hook 36 to be inserted into the slit 26 as shown in FIG. 3C and have the surface of the accessory bag, pouch, or case that is adjacent to the Accessorail System panel 24 lay flat against the Accessorail System panel 24. The minimal distance d being slightly longer than the thickness of the layered reinforcing material of the rail 22 that the slits 26 are formed in and that is attached to the attachment panel 24. In some embodiments, the Accessorail System 24 may be layered with a with reinforced material for durability. The outer layer may in some embodiments have an outer surface 58 that is preferably covered with a hook and loop fastener material such as Velcro® and the Accessorail System accessory may have a fabric layer or other type of mating material along the back surface 60 as shown in FIG. 5D, so that the back surface 60 of the accessory adheres to the hook and loop fastener of the Accessorail System panel 24 to further secure the accessory and prevent the accessory from swinging and tipping. The hook and loop fastener on the outer surface 58 also prevents the J-hooks 36 from dislodging from the slits 26 of the Accessorail System rails 22 as the cart bag 12 is carried or otherwise transported while playing keeping items secure within the accessory.

Figures 4A, 4B, 4C, 4D, 4E, 4F, 4G:
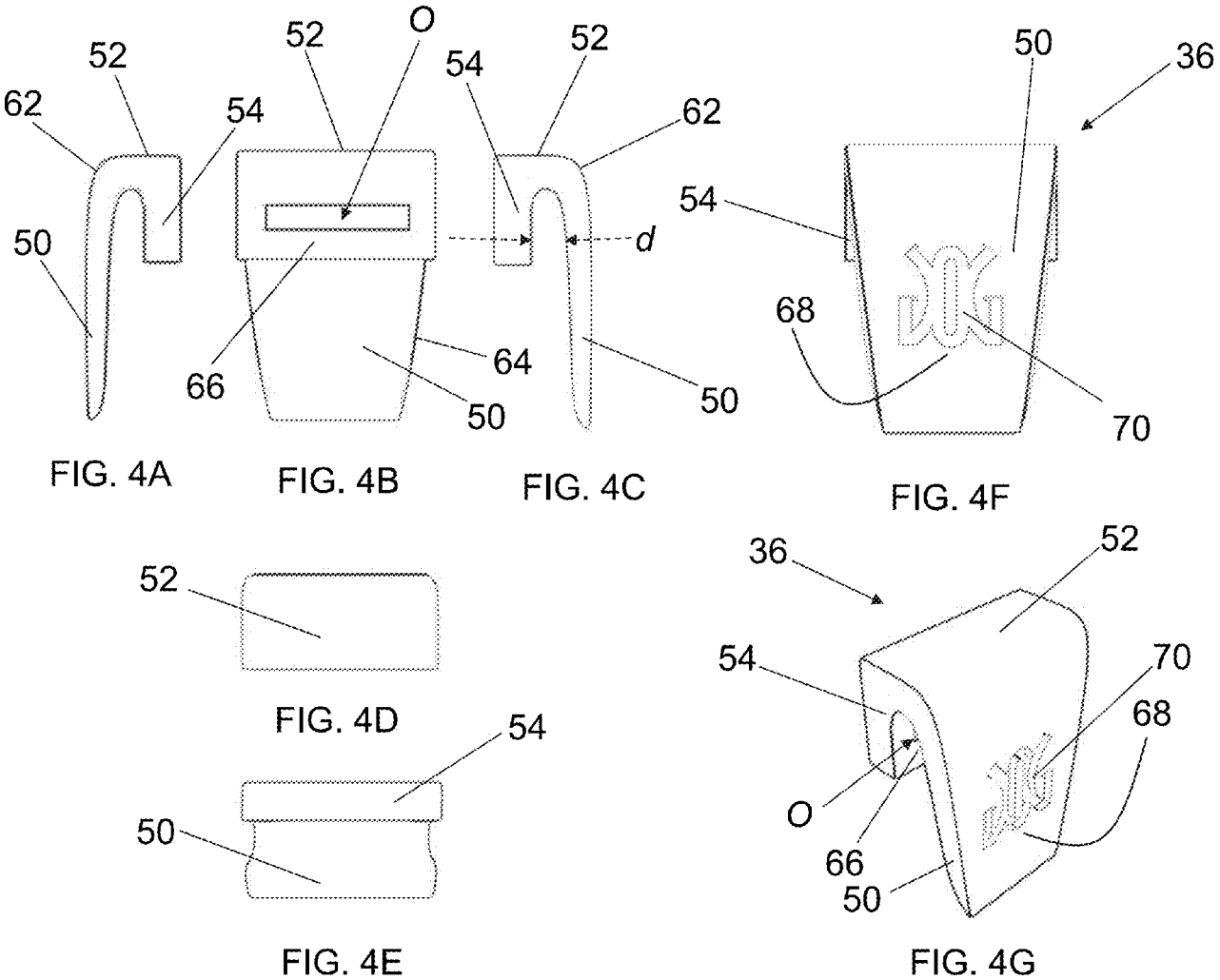
FIG. 4A is a right-side elevation view of an embodiment of the Accessorail System J-hook of the present invention.
FIG. 4B is a rear elevation view of an embodiment of the Accessorail System J-hook of the present invention.
FIG. 4C is a left-side elevation view of an embodiment of the Accessorail System J-hook of the present invention.
FIG. 4D is a top view of an embodiment of the Accessorail System J-hook of the present invention.
FIG. 4E is a bottom view of an embodiment of the Accessorail System J-hook of the present invention.
FIG. 4F is a front elevation view of an embodiment of the Accessorail System J-hook of the present invention.
FIG. 4G is a perspective view of an embodiment of the Accessorail System J-hook of the present invention.

As shown in FIGS. 4A-4G, the Accessorail System J-hook 36 may have a curve 62 to remove any sharp edges along the portion of the J-hook 36 that mates the extender 50 to the top portion 52. A lengthened curved taper 64 is also provided along the vertical edge of the extender 50 to have the extender 50 easily slide into the slit 26. The back frame 54 is provided with an opening O formed by a cross bar 66 which provides for a strap of fabric or other material that is attached to the Accessorail System accessory to be looped through the opening O and over the cross bar 66 and be reattached to the Accessorail System accessory to secure the J-hook 36 to the accessory. In some embodiments, the Accessorail System J-hook 36 may be attached to the sports equipment bag and the Accessorail System rail 22 with slits 26 is along a rear panel of the accessory. A top view of the J-hook 36 showing the top portion 52 is shown in FIG. 4D and a bottom view showing the extender 50 and back frame 54 is shown in FIG. 4E. A front elevation view that shows the front surface 68 of the extender 50 is shown in FIG. 4F. The front surface 68 may indicia 70 such as a logo or trade name along the surface 68. A perspective view of the Accessorail System J-hook 36 is shown in FIG. 4G.

Figure 5F:
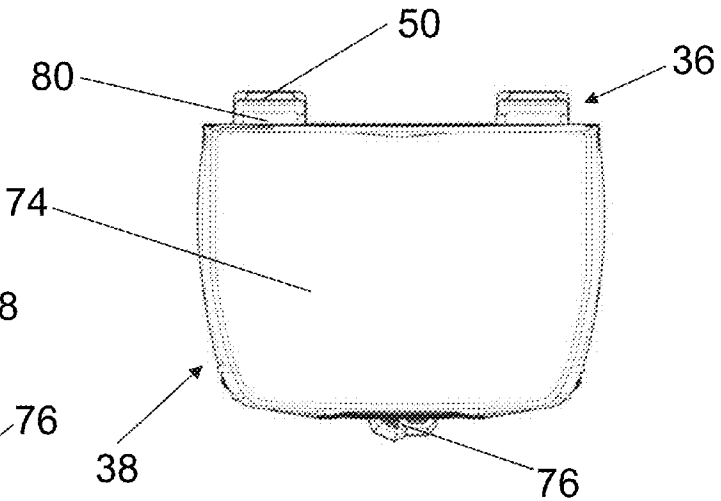
FIG. 5F is a bottom view of an embodiment of the Accessorail System accessory pouch of the present invention.
Figure 5G:
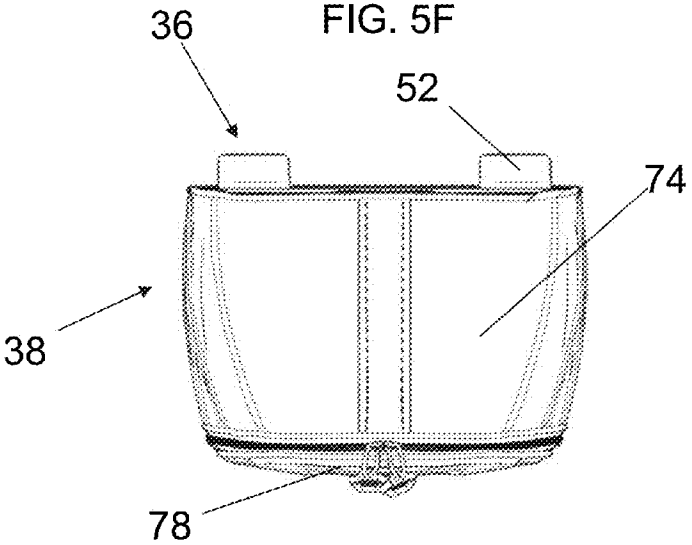
FIG. 5G is a top view of an embodiment of the Accessorail System accessory pouch of the present invention.
Figure 5E:
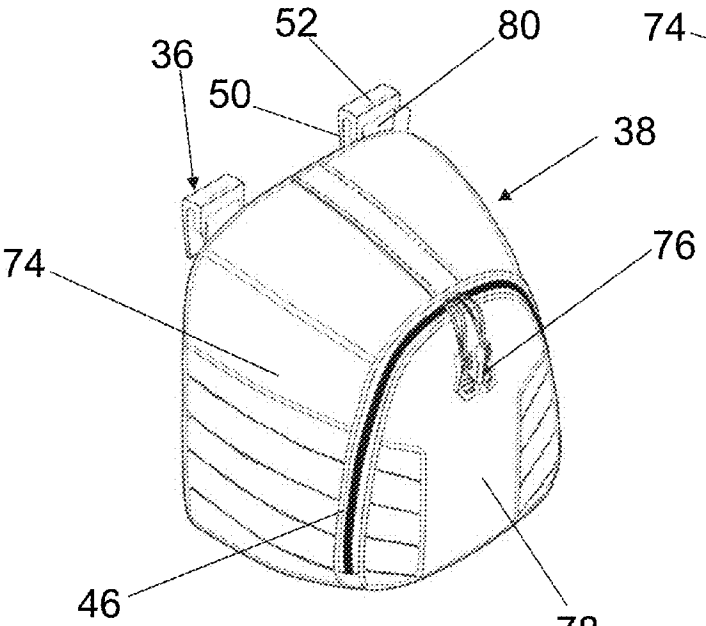
FIG. 5E is a perspective view of an embodiment of the Accessorail System accessory pouch of the present invention.

Many different types, shapes and sizes of Accessorail System accessories are contemplated within the scope of the present invention with specially designed shapes configured to carry and protect specific types of equipment. For example, the Accessorail System accessories may comprise cigar holders, cooler pockets, flask pockets, golf ball holders, garment or apparel accessory bags, accessory pouches of various sizes and shape, rangefinder cases, speaker pockets, sunglass cases, tablet pockets, valuables pockets, watch cases and water packs. Each type of accessory may be provided with appropriate pockets, pouches and compartments to suit a particular purpose or provide a general all purpose type bag or container to hold various items, such as the small accessory pouch 38 shown in FIGS. 5A-5G. The accessory pouch 38 has a compartment 74 that is secured using a zipper 46. As shown in FIG. 5C, a flap 78 along the front of the pouch 38 is opened and closed by pulling on pull tabs 76 to zip or unzip the flap 78 from the pouch and open the compartment 74. The Accessorail System J-hooks 36 are attached to the pouch 38 by sliding a strap 80 through the opening O in the back frame 54 of the J-hook 36, looping the strap 80 over the cross bar 66 and sewing or otherwise attaching the strap 80 to the rear panel 82 of the accessory pouch 38, as shown in FIG. 5D. As noted above the outer surface 60 of the rear panel 82 may be of fabric or of a hook and loop fastener like Velcro® to mate with the hook and loop fastener on the outer surface 58 of the Accessorail System panel 24 to secure the entire outer surface 60 or a portion of the outer surface 60 of the rear panel 82 to the Accessorail System panel 24 to hold the accessory pouch in a consistent orientation and prevent the J-hooks 36 from dislodging from the slits 26. While the hook and loop fastener surface is not a necessity in all embodiments, in some embodiments particularly with a cooler or to protect a tablet or other piece of equipment from damage the hook and loop fastener is an important feature to hold the accessory in a particular orientation and secure the Accessorail System accessory to the Accessorail System golf or another type sports equipment bag. A perspective view of the accessory pouch 38 is shown in FIG. 5E with the attachment of the J-hook 36 to the accessory pouch 38 using the strap 80. A bottom view of the accessory pouch 38 is shown in FIG. 5F and a top view is shown in FIG. 5G.

Figure 6C:
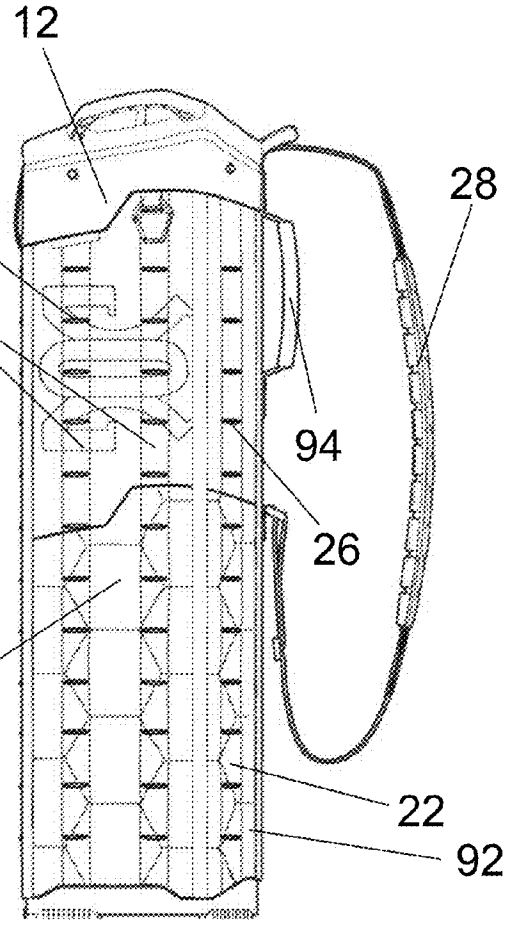
FIG. 6C is a right-side elevation view of an embodiment of the Accessorail System cart bag of the present invention.
Figure 6B:
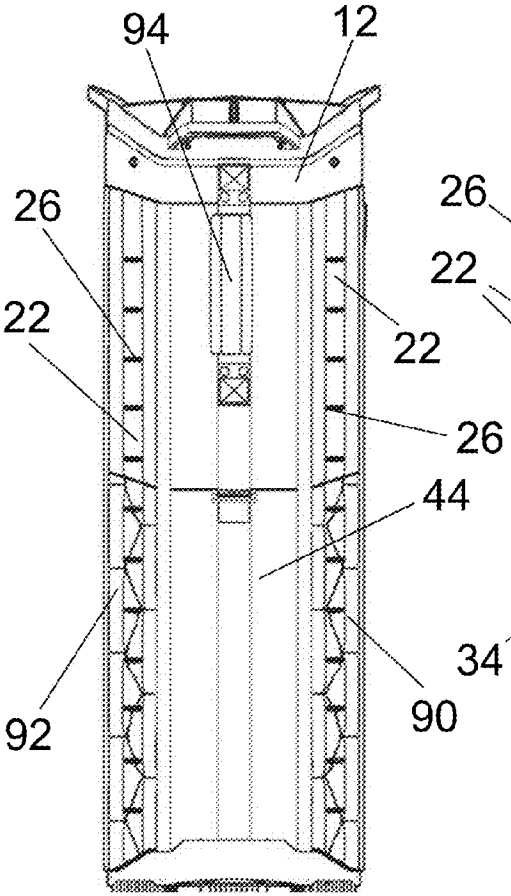
FIG. 6B is a rear elevation view of an embodiment of the Accessorail System cart bag of the present invention.
Figure 6A:
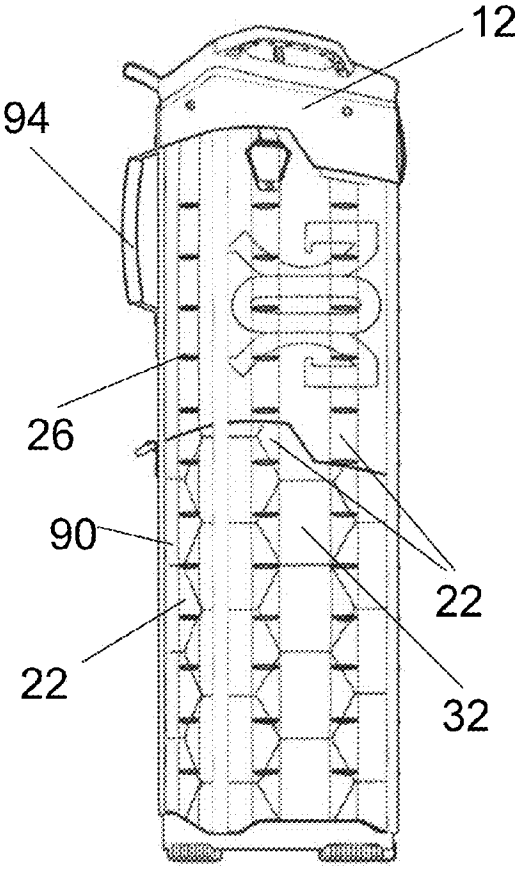
FIG. 6A is a left-side elevation view of an embodiment of the Accessorail System cart bag of the present invention.

As shown in FIGS. 6A-6C, the Accessorail System cart bag 12 may have a uniquely designed angled left side 32 as shown in FIG. 6A and angled right side 34 as shown in FIG. 6C, so that a first set of Accessorail System rails 22 is directed outwards towards the front 30 of the cart bag 12 providing a larger service area for the attachment of Accessorail System accessories. A single Accessorail System rail 22 is provided along an Accessorail System panel 24 along a left rear section 90 and a single Accessorail System rail 22 is provided along another Accessorail System panel 24 along a right rear section 92 with each of the left and right rear sections 90 and 92 being angled outwards towards the rear of the cart bag 12. The single Accessorail System rail 22 along each rear section 90 and 92 provides for the attachment of smaller Accessorail System accessories having only a single J-hook such as a water pack, a valuables pouch, a cigar holder, a sunglass case and others. Ample room for the attachment of smaller accessories is provided with a number of slits 26 extended along each single Accessorail System rail 22 on either side of the rear 44 of the cart bag 12, as shown in FIG. 6B.

Figure 7B:
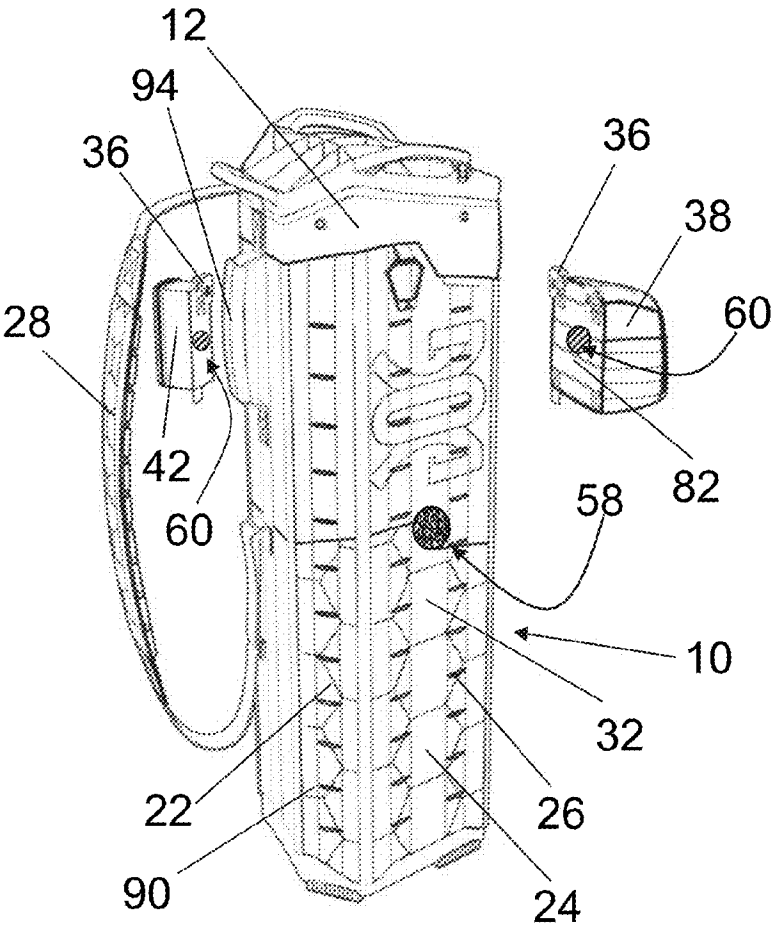
FIG. 7B is a rear perspective view of an embodiment of the Accessorail System cart bag of the present invention.
Figure 7A:
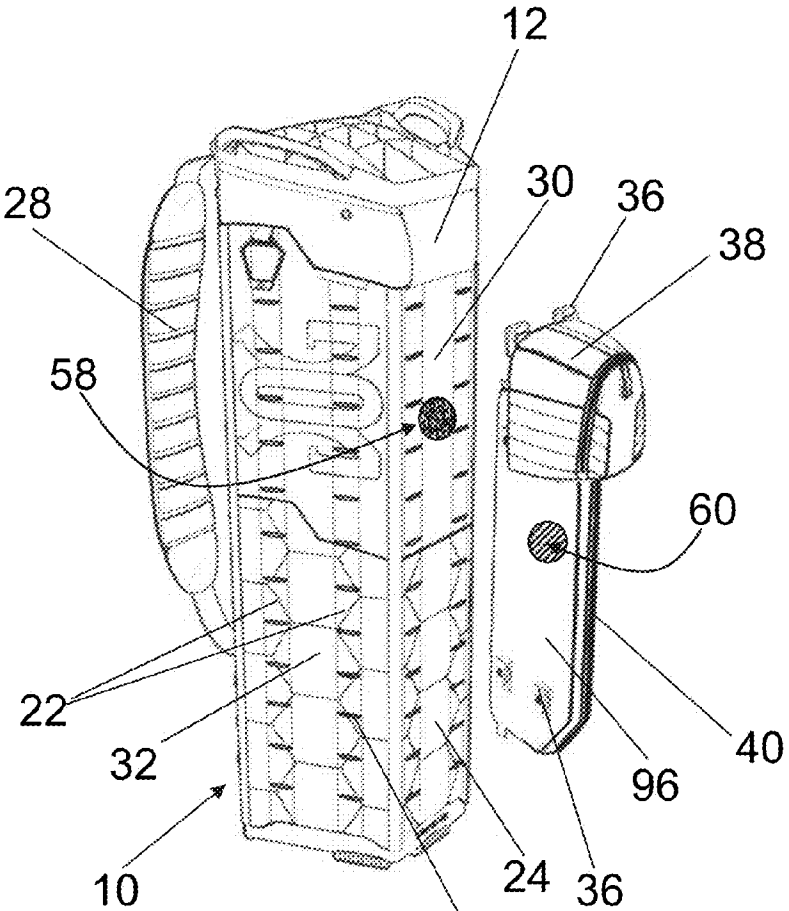
FIG. 7A is a front perspective view of an embodiment of the Accessorail System cart bag of the present invention.

The angled-out side and rear panels are shown in perspective views from the front in FIG. 7A and from the rear in FIG. 7B providing for different size, type and purpose accessories to be attached at desired locations by a player to have items properly stored and organized. The Accessorail System 10 also provides for the easy detachment of an accessory that is not needed removing added weight and thereby customizing a player's sports equipment bag to exactly the items that are needed. The small accessory bag 38 may be attached to the front 30, an apparel bag 40 may be attached to the right-side 34 and a sunglass case 42 may be attached to the right-side rear section 92. Each Accessorail System panel 24 may have an outer surface 58 having a hook and loop fastener such as Velcro® and the rear surface 60 of the accessories such as the back 96 of the apparel bag 40 may be of fabric or a mating material to secure the entire rear surface 60 to the Accessorail System panel 24.

Figure 8B:
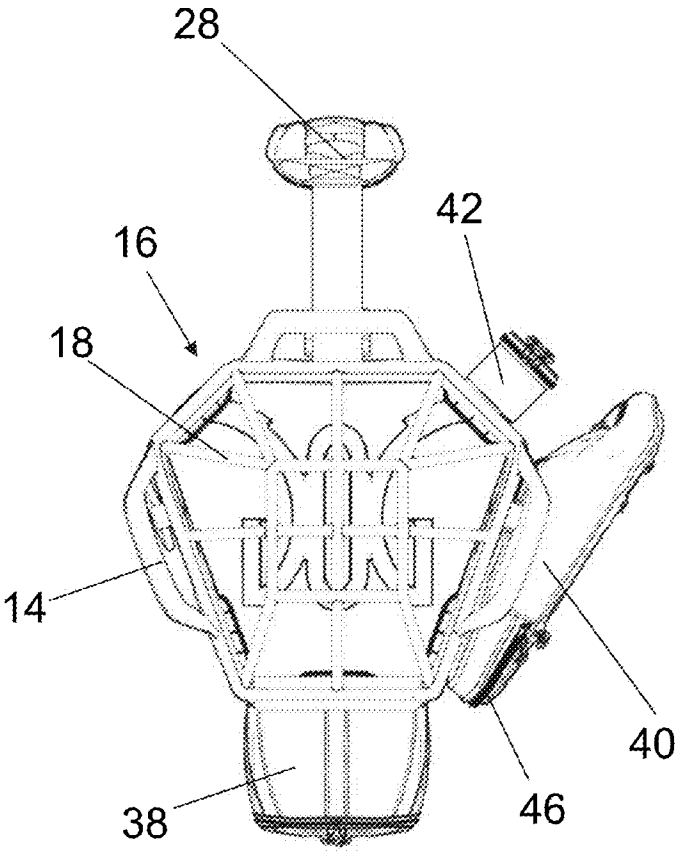
FIG. 8B is a top view with an embodiment of accessories in an embodiment of the Accessorail System cart bag of the present invention.
Figure 8A:
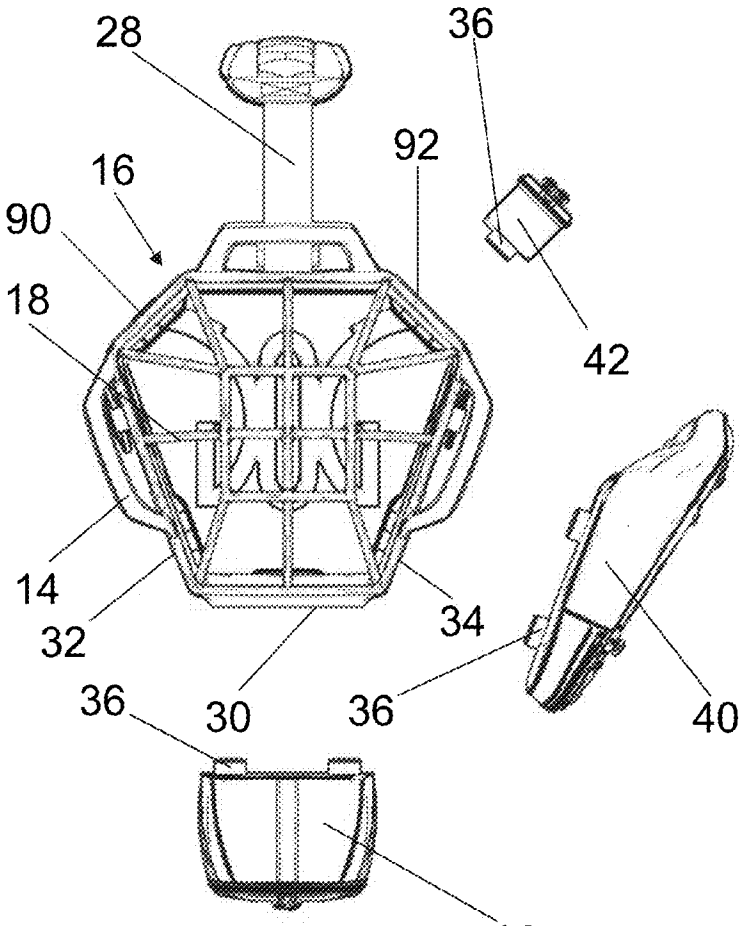
FIG. 8A is a top assembly view with an embodiment of accessories in an embodiment of the Accessorail System cart bag of the present invention.
Figure 9B:
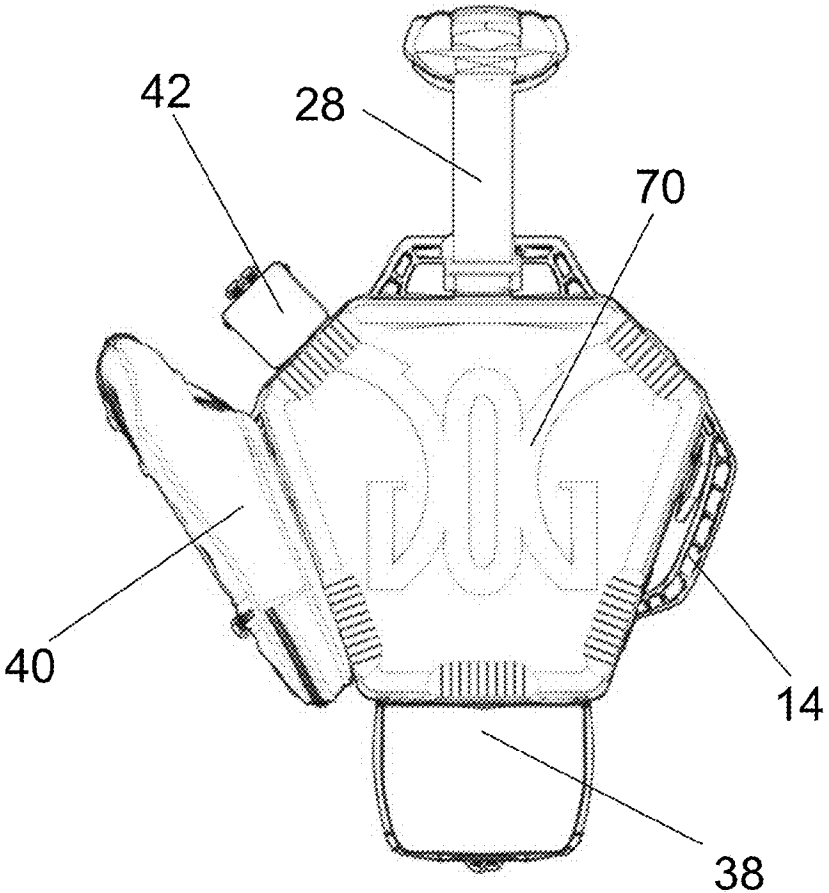
FIG. 9B is a bottom view with an embodiment of accessories in an embodiment of the Accessorail System cart bag of the present invention.
Figure 9A:
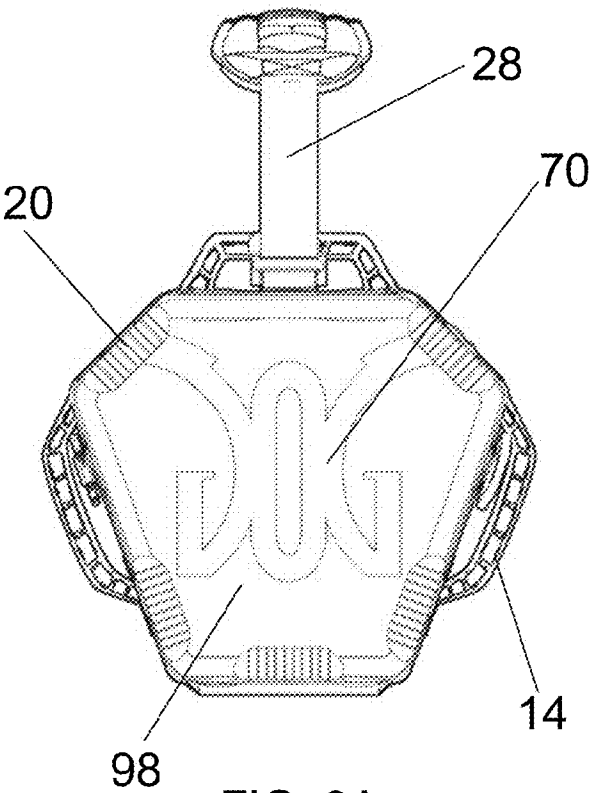
FIG. 9A is a bottom view of an embodiment of the Accessorail System cart bag of the present invention.
Figure 10B:
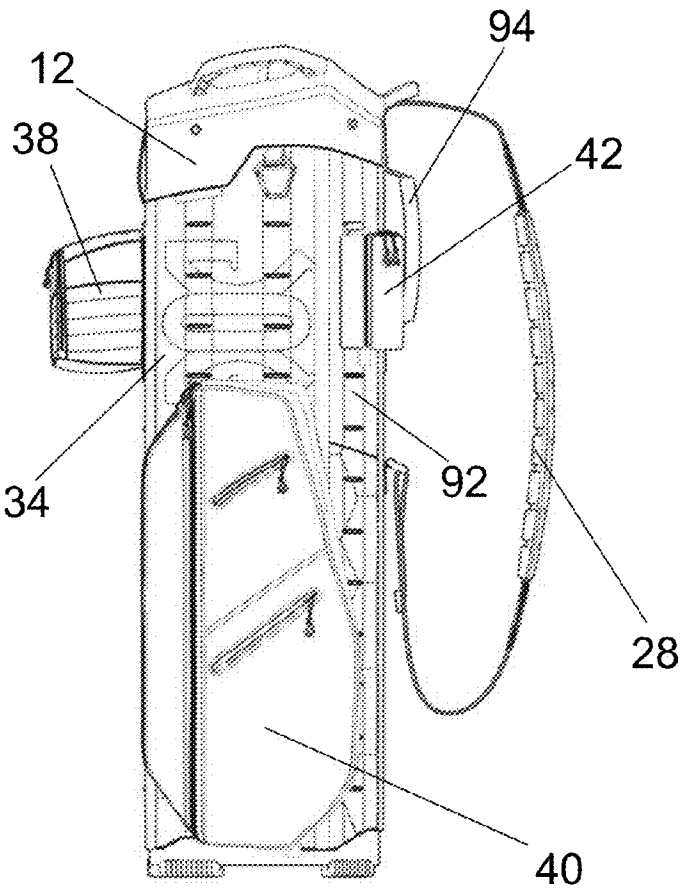
FIG. 10B is a right-side elevation view with an embodiment of accessories in an embodiment of the Accessorail System cart bag of the present invention.
Figure 10A:
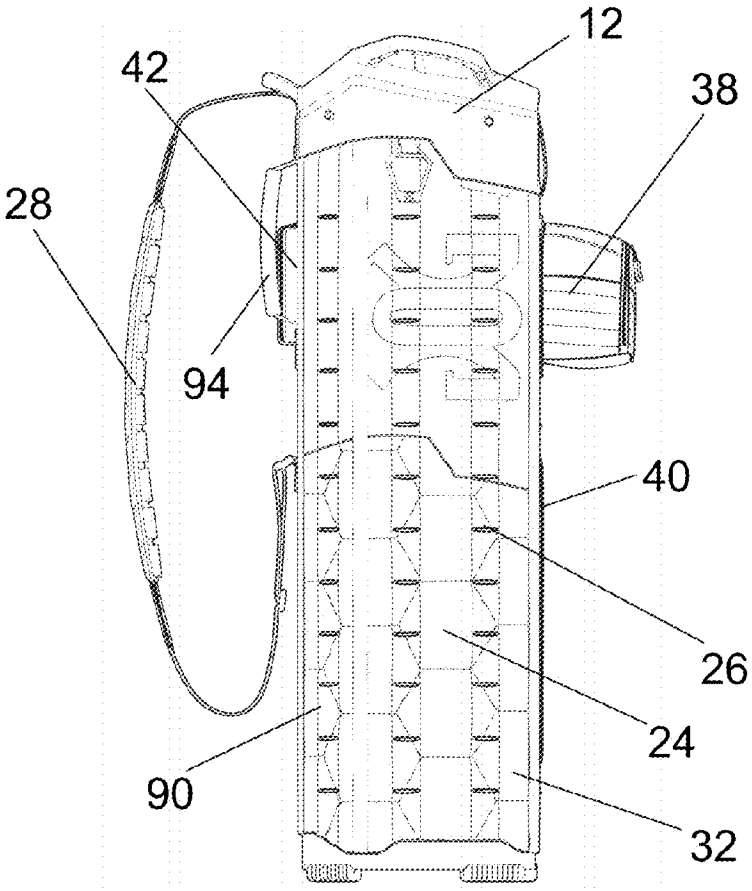
FIG. 10A is a left-side elevation view with an embodiment of accessories in an embodiment of the Accessorail System cart bag of the present invention.

As shown in FIG. 8A, in a top assembly view the unique shape of the Accessorail System cart bag 12 is shown. As shown, the small accessory pouch is aligned with the front 30, the apparel bag 40 is aligned with the right-side 34 and the sunglass case 42 is aligned with the right-rear section 92. Each accessory is attached using the Accessorail System J-hooks and secured against the Accessorail System panels 24 using the hook and loop fastener surface 58 and mating surface 60 as shown in FIG. 8B. A bottom view of the Accessorail System cart bag 12 without accessories is shown in FIG. 9A. The sturdy base supports 20 and flat bottom provide for the Accessorail System cart bag 12 to stand both with and without the attachment of accessories. The flat bottom surface 98 provides for indicia 70 such as a logo or trade name to be added. A bottom view of the Accessorail System cart bag 12 with accessories attached is shown in FIG. 9B. A left-side 32 elevation view with the attachment of the small accessory pouch 38, the apparel bag 40, and the sunglass case 42 is shown in FIG. 10A. A right-side 34 elevation view with the attachment of the small accessory pouch 38, the apparel bag 40, and the sunglass case 42 is shown in FIG. 10B.

Figure 11B:
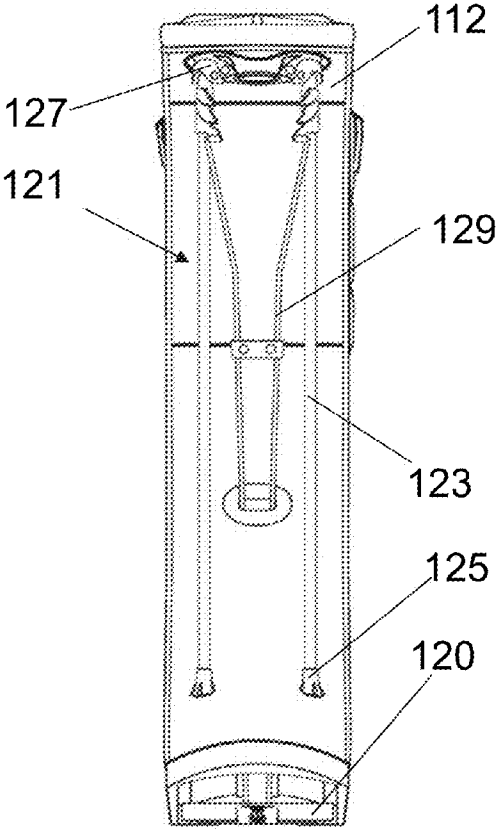
FIG. 11B is a front elevation view of an embodiment of the Accessorail System stand bag of the present invention.
Figure 11A:
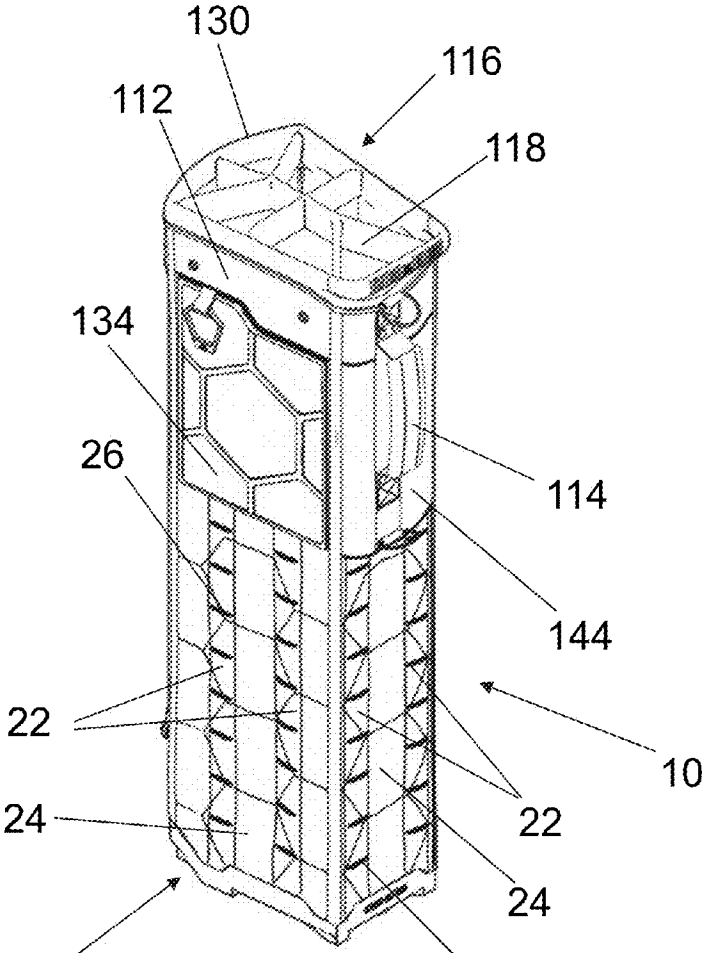
FIG. 11A is a rear perspective view of an embodiment of the Accessorail System stand bag of the present invention.
Figures 11C, 11D, 11E:
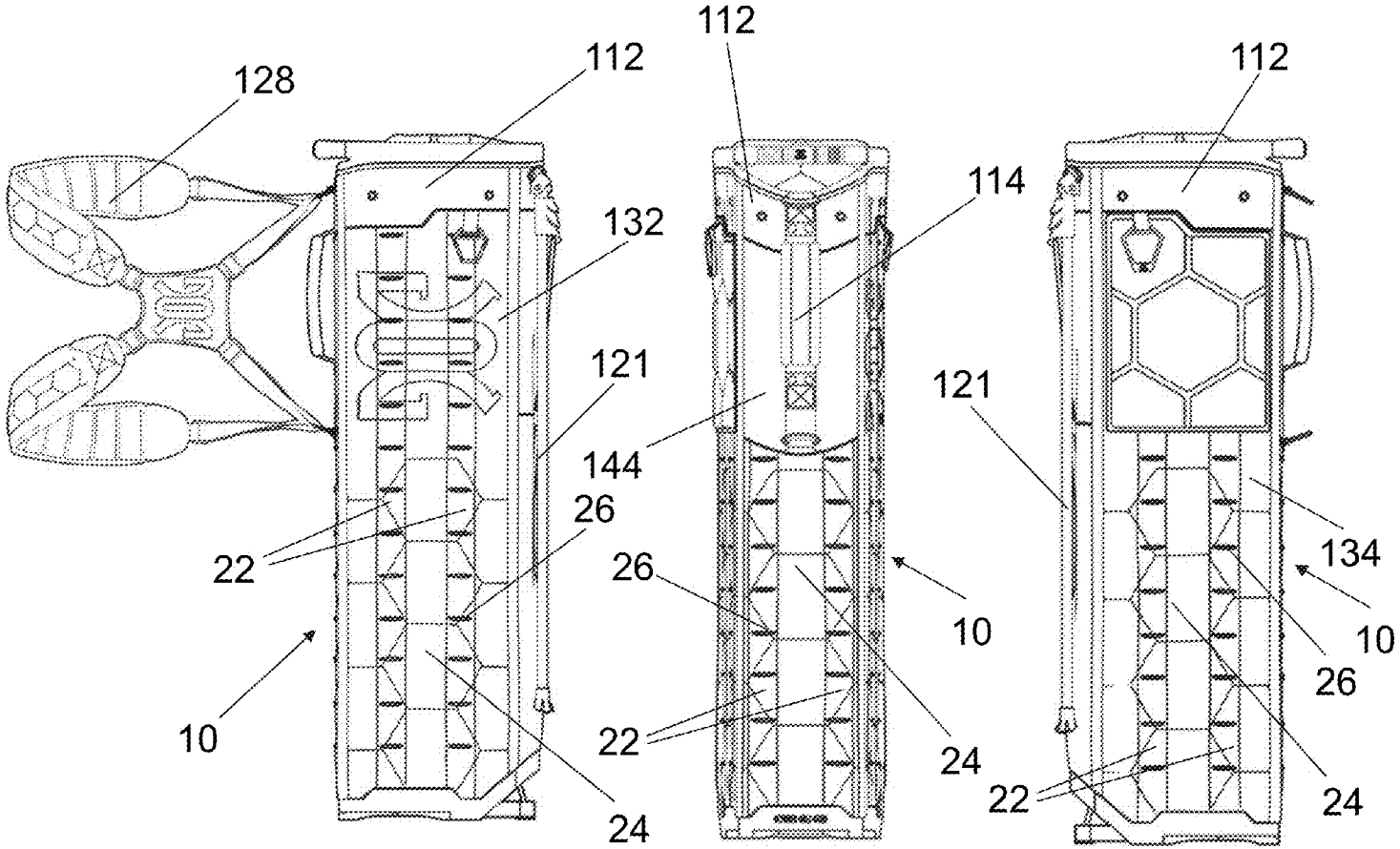
FIG. 11C is a left-side elevation view of an embodiment of the Accessorail System stand bag of the present invention.
FIG. 11D is a rear elevation view of an embodiment of the Accessorail System stand bag of the present invention.
FIG. 11E is a right-side elevation view of an embodiment of the Accessorail System stand bag of the present invention.

In a further embodiment, the Accessorail System stand golf bag 112 is shown in FIG. 11A. Similarly, to the Accessorail System cart bag 12, the Accessorail System stand bag 112 is made of a lightweight durable material such as a plastic composites, leather, Kevlar, nylon, canvas, carbon fiber, and/or other sturdy fabrics and materials to support and protect a player's golf clubs, personal items, and other sporting equipment. The Accessorail System stand bag 112 has a handle 114 and a club compartment 116 with separators 118. From a rear panel 144, the left-side 132 and the right-side 134 extend at an angle that is wider than 90 degrees to mate with a curved front 130. As shown in FIG. 11B, the curved front 130 has a stand 121 to support the golf bag which by tipping the Accessorail System stand bag 112 forward allows the stand bag 112 to rotate on its base support 120 and have the legs 123 of the stand 121 fall forward and rest on feet 125 to support the Accessorail System stand bag 112 in a leaning position. The legs 123 are attached to a pivot connector 127 at the top of the front 130 and a support brace 129 stabilizes and secures the stand bag 112 in the leaning position. The Accessorail System 10 is along all or a portion of the left-side 132, the right-side 134 and the rear 144 with a pair of Accessorail System rails 22 having a number of slits 26 along each Accessorail System panel 24 as shown in a left-side elevation view in FIG. 11C, in a rear view in FIG. 11D, and in a right-side view in FIG. 11E. A shoulder strap 128 may be provided with the Accessorail System stand bag 112 as shown in FIG. 11C.

Figure 12B:
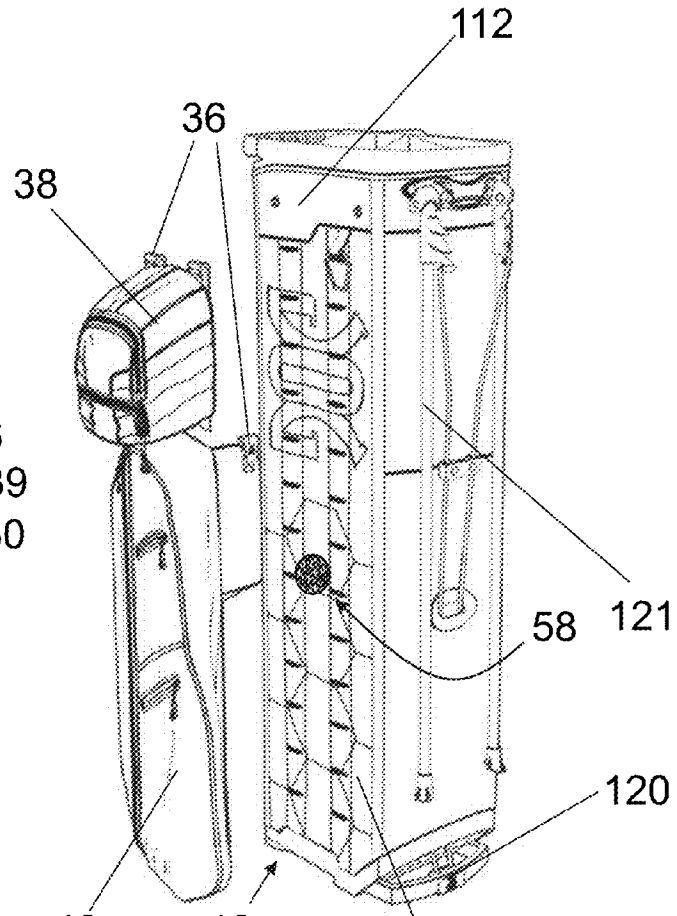
FIG. 12B is a left-front perspective view with an embodiment of accessories in an embodiment of the Accessorail System stand bag of the present invention.
Figure 12A:
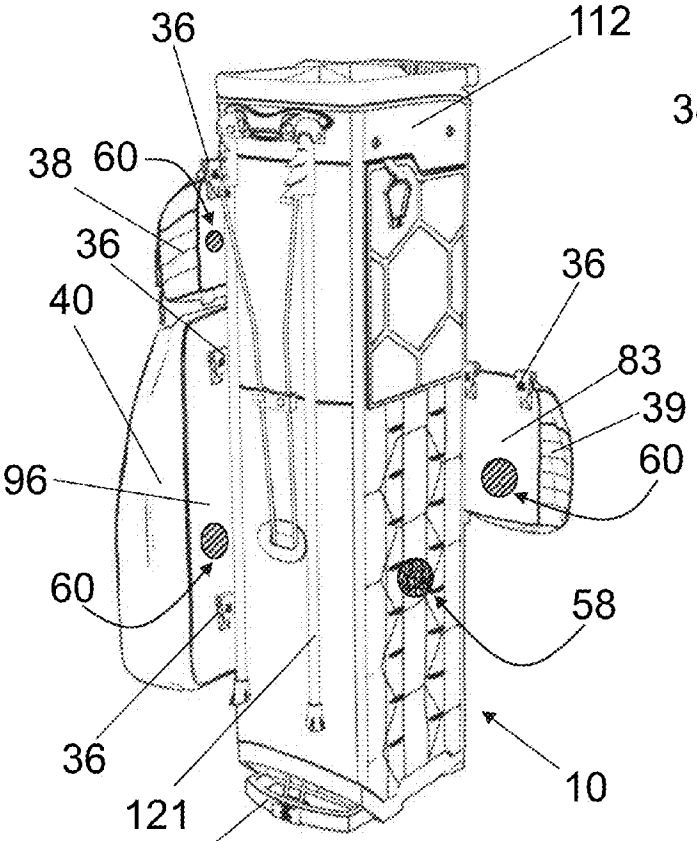
FIG. 12A is a right-front perspective view with an embodiment of accessories in an embodiment of the Accessorail System stand bag of the present invention.
Figure 12D:
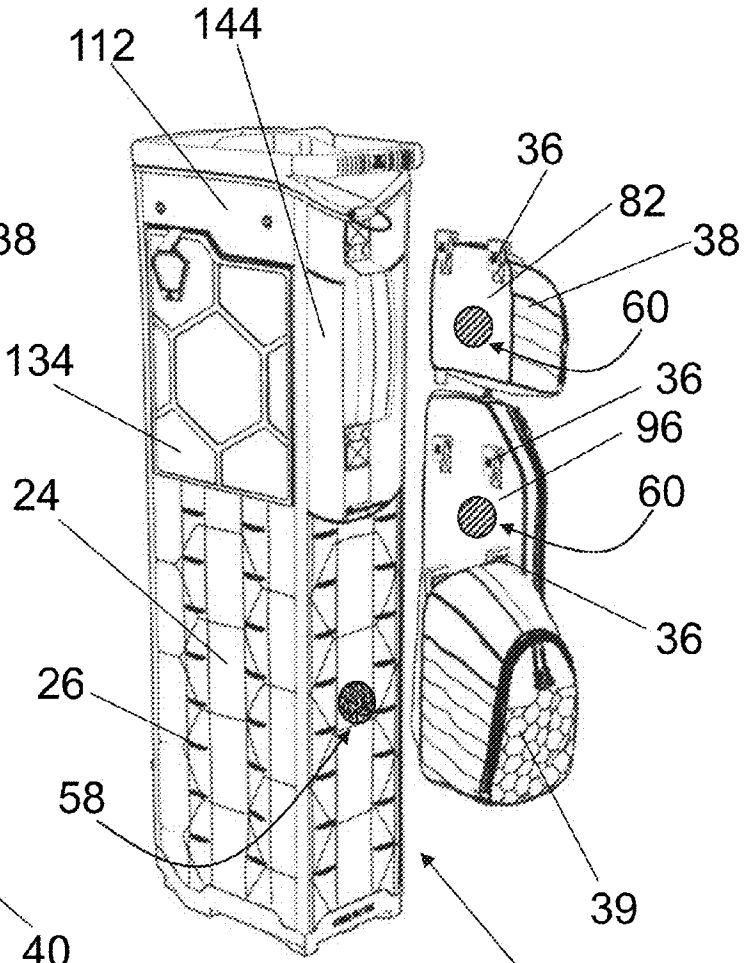
FIG. 12D is a right-rear perspective view with an embodiment of accessories in an embodiment of the Accessorail System stand bag of the present invention.
Figure 12C:
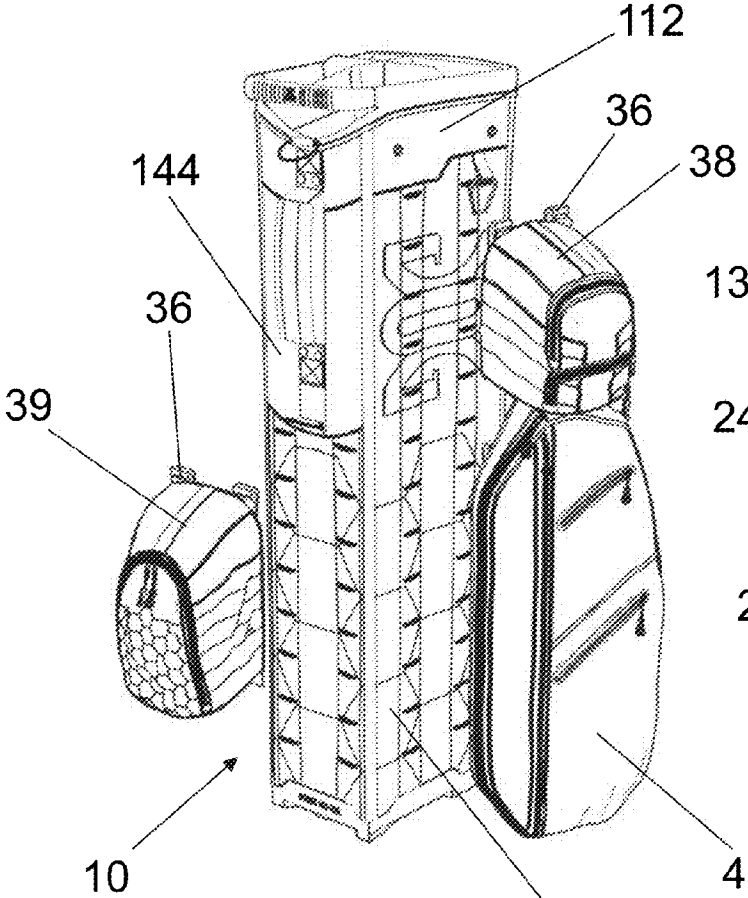
FIG. 12C is a left-rear perspective view with an embodiment of accessories in an embodiment of the Accessorail System stand bag of the present invention.

The Accessorail System 10 is similarly incorporated with the stand bag 112 as it is with the cart bag 12 and provides for the attachment to the stand bag 112 of a number of different types of Accessorail System accessories to allow a player to customize the Accessorail System stand bag 112 in a way that they want and add or remove accessories to carry only what is needed an important consideration when a player is carrying their golf bag throughout the golf course. As shown in FIG. 12A, a small accessory bag 38, an apparel bag 40 are aligned along the left-side 132 and a medium sized accessory 39 is aligned along the rear 144 to be attached to the Accessorail System stand bag 112. As noted above, each Accessorail System panel 24 may have an outer surface 58 having a hook and loop fastener such as Velcro® and the rear surface 60 of the accessory such as the back 96 of the apparel bag 40, the rear panel 82 of the small accessory pouch or the rear panel 83 of the medium sized accessory pouch 39 may be of fabric or a mating material to secure the entire rear surface 60 or a portion of the rear surface 60 to the Accessorail System panel 24. One or more accessories may be aligned on the left-side 132 of the Accessorail System stand bag 112 by selecting slits 26 along the Accessorail System rails 22 to properly space the accessories for adequate access as shown in FIG. 12B. A rear perspective view showing the alignment of the medium accessory pouch 39 along the rear 144 of the stand cart 112 and the alignment of the small accessory pouch 28 and the apparel bag 40 is shown in FIG. 12C. The rear panel 82 of the small accessory pouch 38 and rear 96 of the apparel bag is shown in FIG. 12D with the fabric or mating outer surface 60 to have the surface of the accessory adhere to the hook and loop fastener 58 of Accessorail System panel 24.

Figures 13A, 13B, 13C:
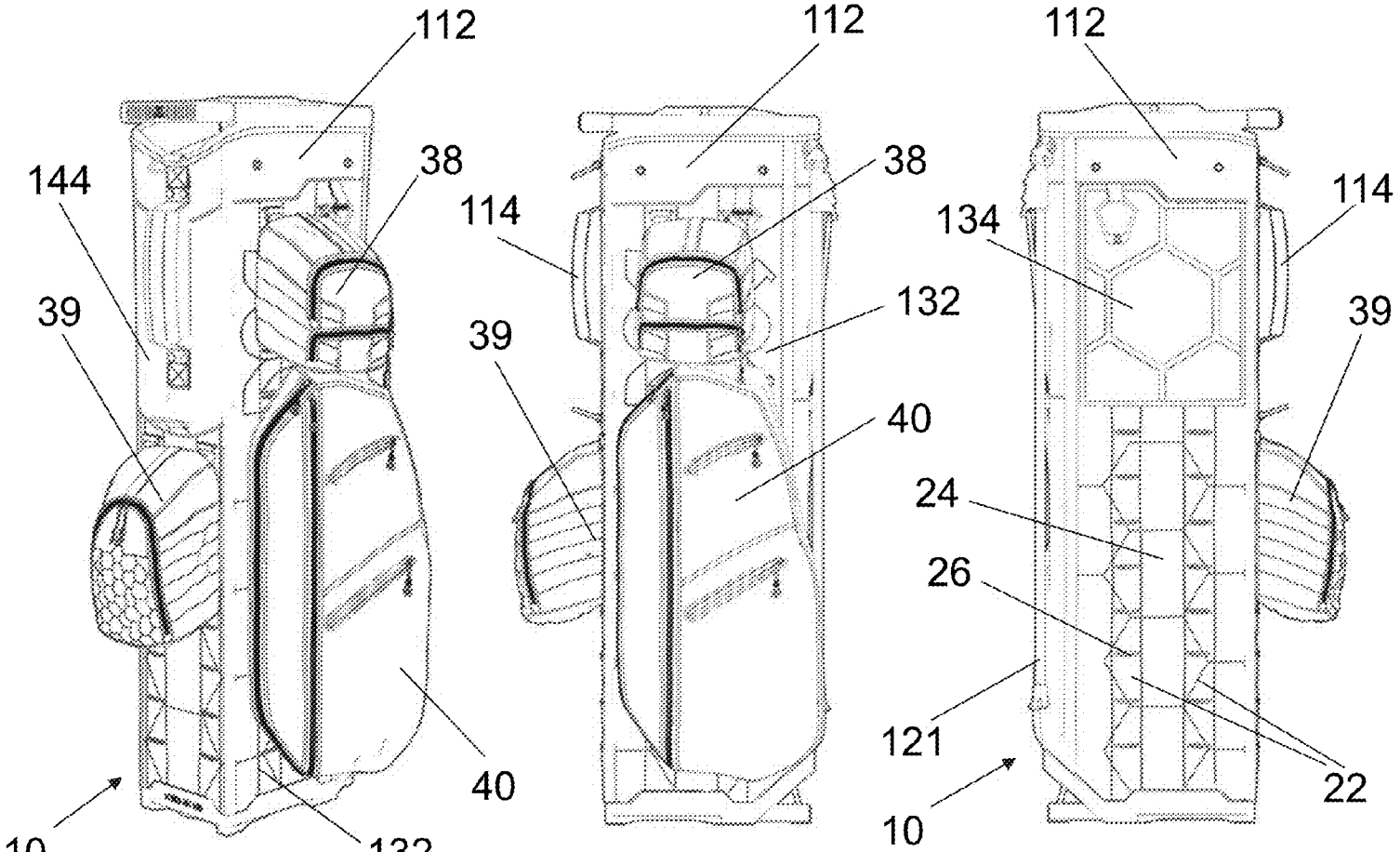
FIG. 13A is a left-rear perspective view with an embodiment of accessories in an embodiment of the Accessorail System stand bag of the present invention.
FIG. 13B is a left-side elevation view with an embodiment of accessories in an embodiment of the Accessorail System stand bag of the present invention.
FIG. 13C is a right-side elevation view with an embodiment of accessories in an embodiment of the Accessorail System stand bag of the present invention.
Figure 14:
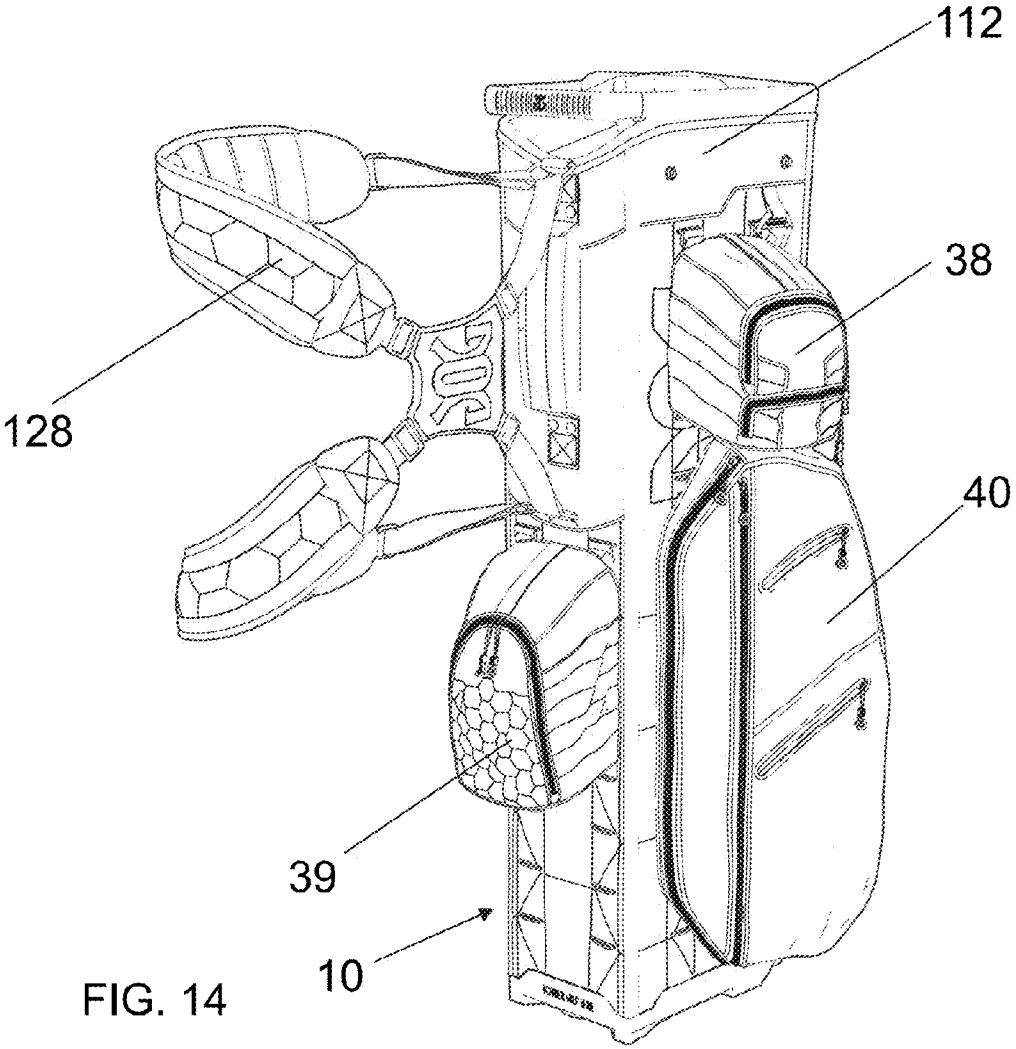
FIG. 14 is a perspective view with an embodiment of a shoulder strap and accessories in an embodiment of the Accessorail System stand bag of the present invention.
Figure 15B:
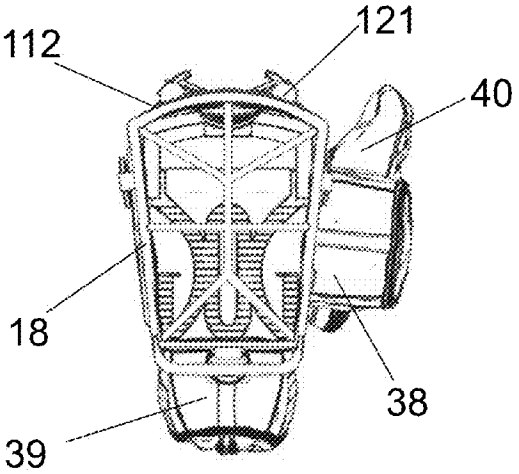
FIG. 15B is a top view with an embodiment of accessories in an embodiment of the Accessorail System stand bag of the present invention.
Figure 15C:
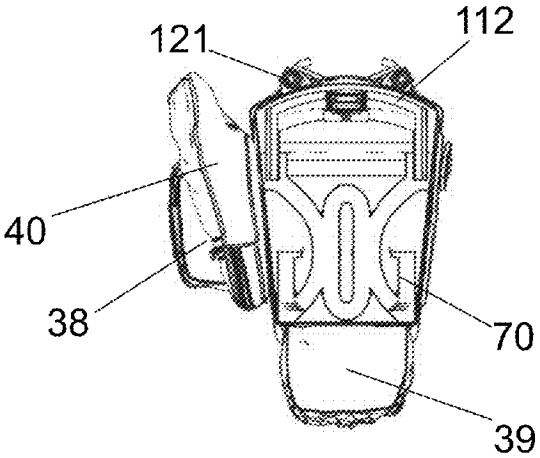
FIG. 15C is a bottom view with an embodiment of accessories in an embodiment of the Accessorail System stand bag of the present invention.
Figure 15A:
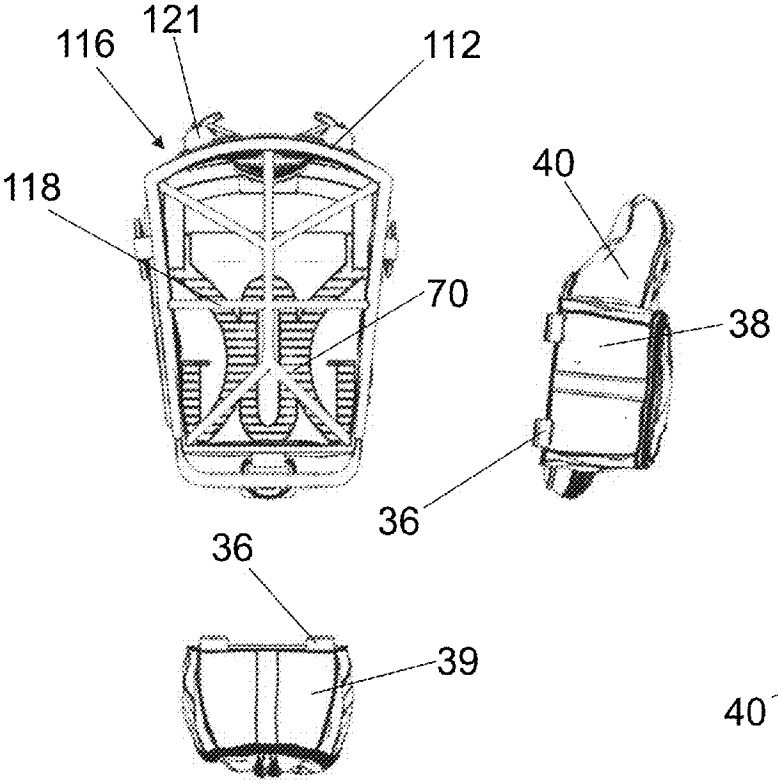
FIG. 15A is a top assembly view with an embodiment of accessories in an embodiment of the Accessorail System stand bag of the present invention.

As shown in FIGS. 13A-13C, using the J-hooks 36, the accessories are attached to the Accessorail System panels 24 at the desired locations to accommodate the accessories desired and needed by the player. The attachment of the medium accessory pouch 39 along the rear 114 and the attachment of the small accessory bag 38 and apparel bag 40 along the left side 132 is shown in a rear perspective view in FIG. 13A, in a left-side elevation view in FIG. 13B, and in a right-side elevation view in FIG. 13C. The Accessorail System stand bag 112 with a shoulder strap 128 and the Accessorail System accessories is shown in FIG. 14. A top assembly view showing an embodiment of the Accessorail System accessories is shown in FIG. 15A and a top view with the attachment of accessories to the Accessorail System stand bag 112 is shown in FIG. 15B. A bottom view with the attachment of accessories to the Accessorail System stand bag 112 is shown in FIG. 15C.

Figures 16A, 16B, 16C, 16D, 16E:
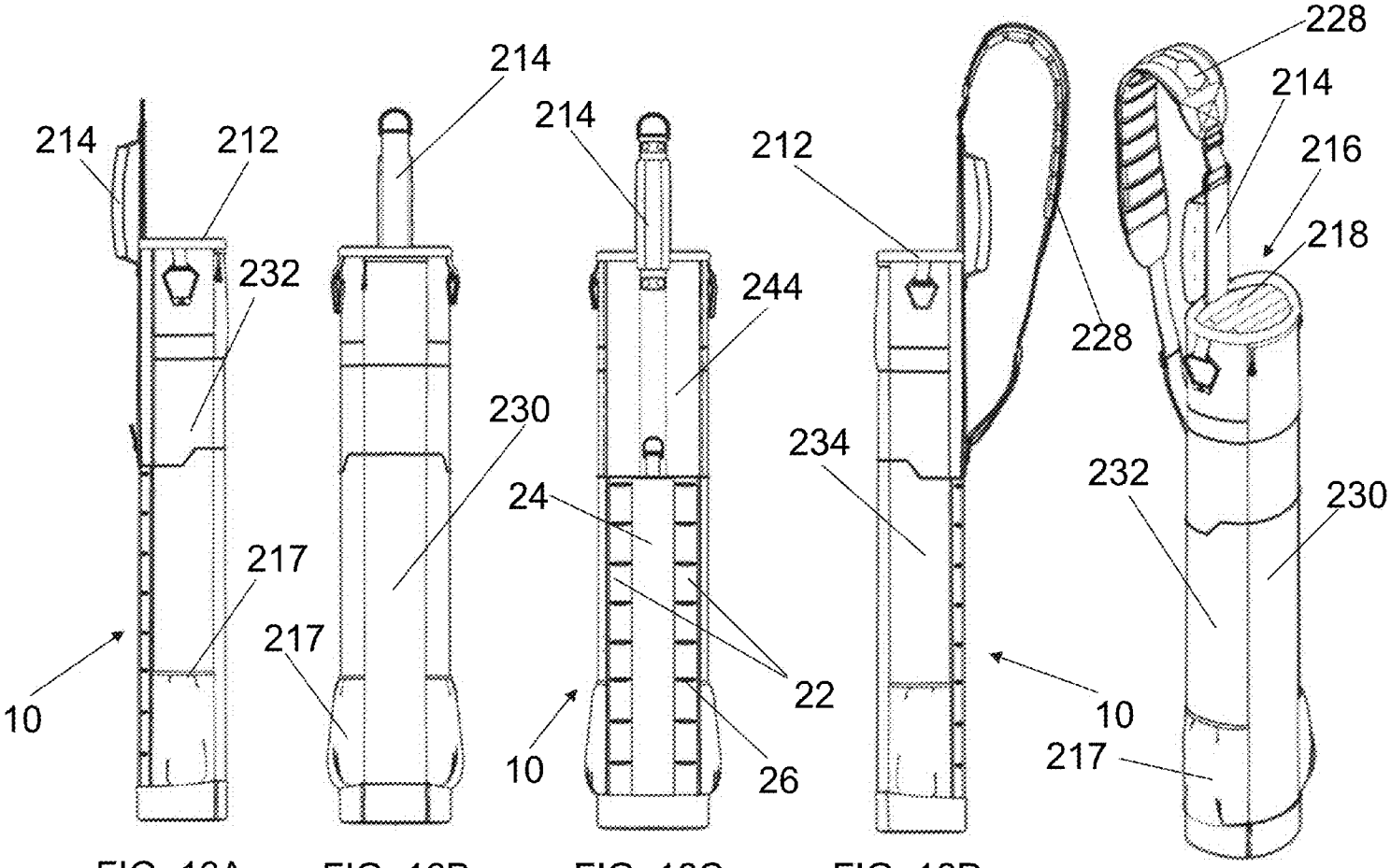
FIG. 16A is a left-side elevation view of an embodiment of the Accessorail System carry bag of the present invention.
FIG. 16B is a front elevation view of an embodiment of the Accessorail System carry bag of the present invention.
FIG. 16C is a rear elevation view of an embodiment of the Accessorail System carry bag of the present invention.
FIG. 16D is a right-side elevation view of an embodiment of the Accessorail System carry bag of the present invention.
FIG. 16E is a perspective view of an embodiment of the Accessorail System carry bag of the present invention.
Figure 18A:
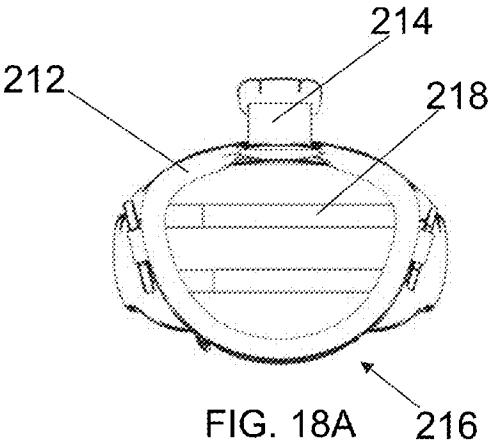
FIG. 18A is a top view of an embodiment of the Accessorail System carry bag of the present invention.
Figure 18B:
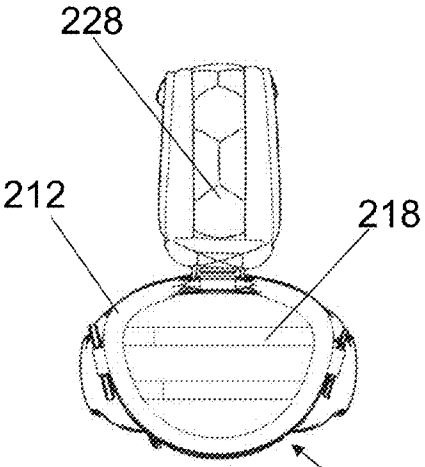
FIG. 18B is a top view of an embodiment of a strap in an embodiment of the Accessorail System carry bag of the present invention.
Figure 17A:
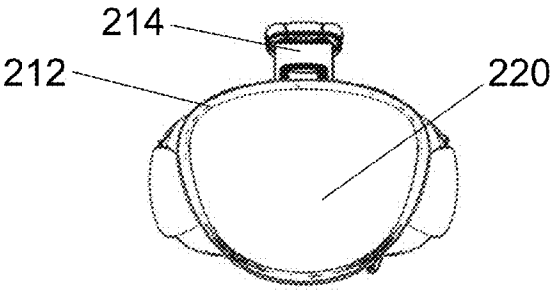
FIG. 17A is a bottom view of an embodiment of the Accessorail System carry bag of the present invention.
Figure 17B:
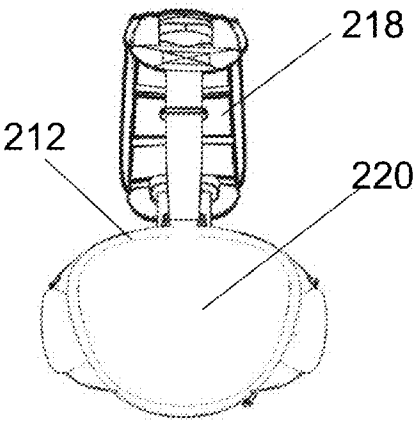
FIG. 17B is a bottom view of an embodiment of a strap in an embodiment of the Accessorail System carry bag of the present invention.

In a further embodiment, the Accessorail System 10 may be incorporated with a carry golf bag 215 which is made of durable materials but is much more lightweight so may be made of a canvas or other lighter fabric than the Accessorail System cart bag 12 or stand bag 112. The Accessorail System carry or weekend bag 212 is shown in FIGS. 16A-16E. To keep a carry golf bag of the prior art lightweight, commonly there are none or only one or two accessory pouches or pockets, so the player is limited to carrying only their golf clubs, tees and balls. The Accessorail System carry bag 212 has a handle 214, club compartment 216 with separators 218, and a detachable strap 228 as shown in FIG. 16E. The front 230 of the Accessorail System carry bag 212 may be curved as shown in FIG. 16B and be formed with a smooth rounded surface that extends around to the left side 232 and the right side 234. In embodiments, of the Accessorail System carry bag 212, pockets 217 may be provided at the base along the left side 232 as shown in FIG. 16A and the right side 234 as shown in FIG. 16D. In an embodiment of the present invention, the Accessorail System 10 is provided along the rear section 244 of the carry bag 212 which may be formed as a substantially flat surface as shown in FIG. 16C. The base 220 is shown in a bottom view of the Accessorail System carry bag 212 in FIG. 17A with the handle 214 but without a strap and with a strap 218 in FIG. 17B. A top view of the Accessorail System carry bag 212 is shown in FIG. 18A with the handle 214 but without a strap and with a strap 218 in FIG. 18B.

Figures 19A, 19B, 19C, 19D:
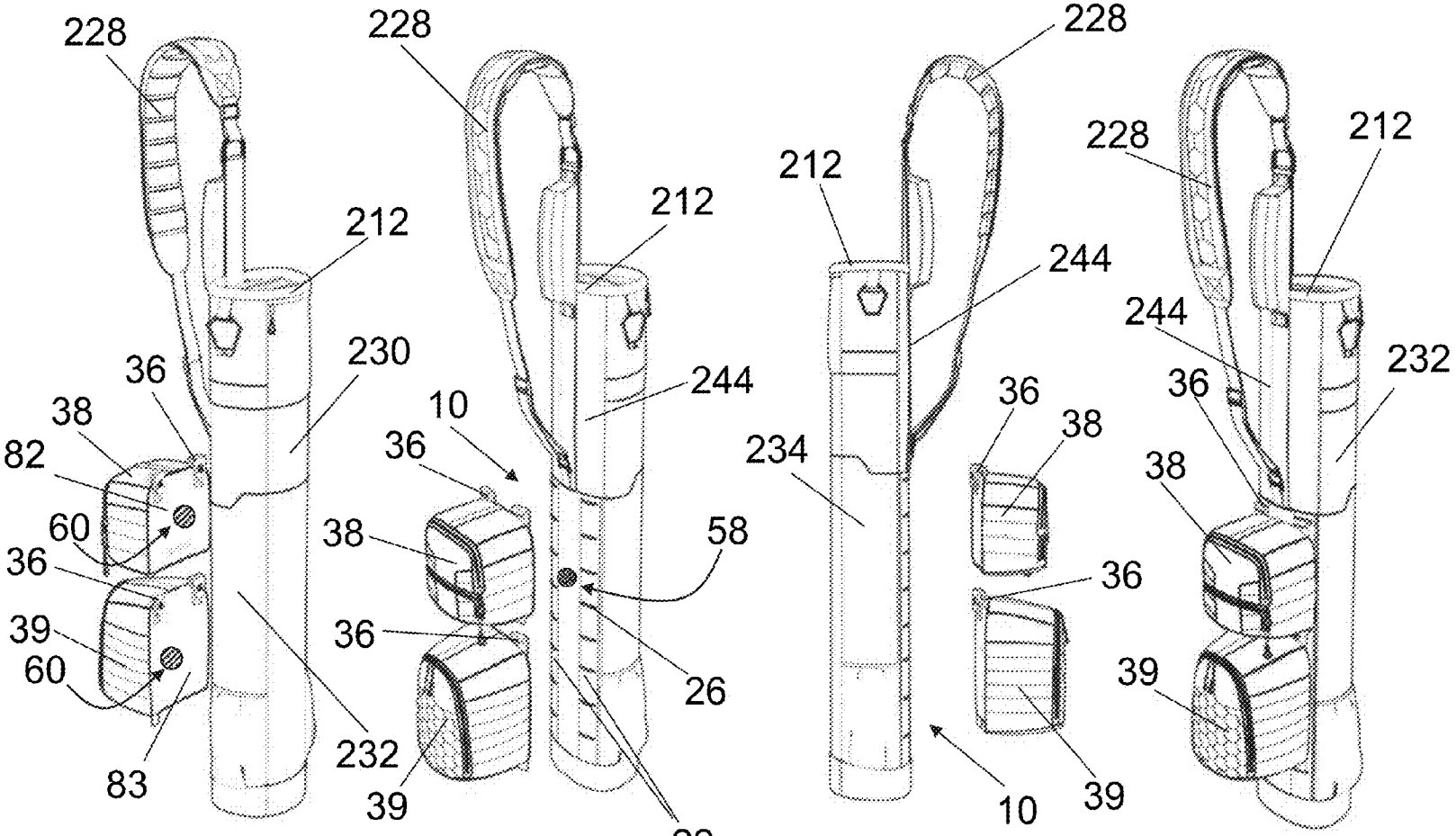
FIG. 19A is a left-front assembly view with an embodiment of accessories in an embodiment of the Accessorail System carry bag of the present invention.
FIG. 19B is a left-rear assembly view with an embodiment of accessories in an embodiment of the Accessorail System carry bag of the present invention.
FIG. 19C is a right-side elevation assembly view with an embodiment of accessories in an embodiment of the Accessorail System carry bag of the present invention.
FIG. 19D is a rear perspective view with an embodiment of accessories in an embodiment of the Accessorail System carry bag of the present invention.
Figures 20A, 20B, 20C:
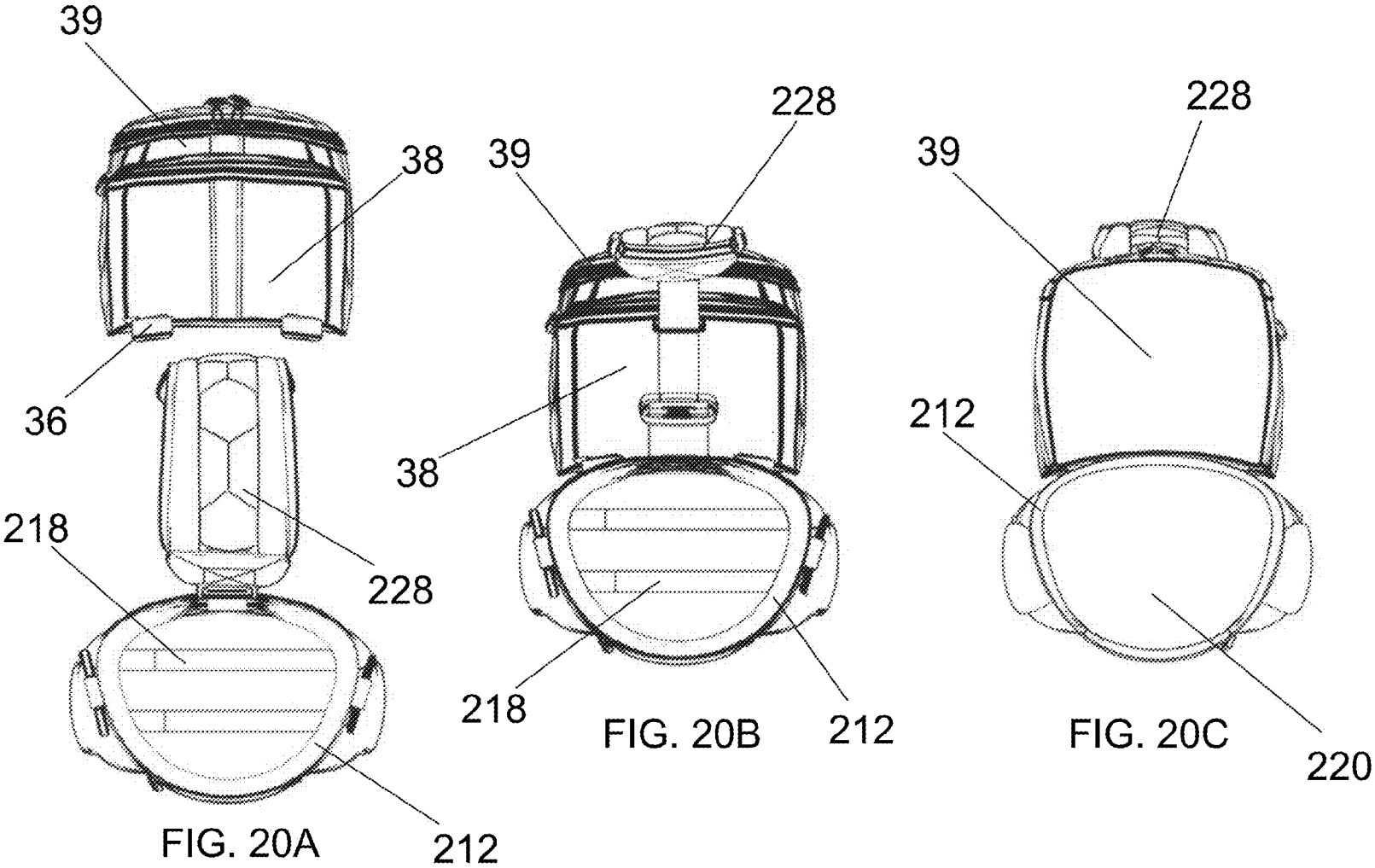
FIG. 20A is a top assembly view with an embodiment of accessories in an embodiment of the Accessorail System carry bag of the present invention.
FIG. 20B is a top view with an embodiment of accessories in an embodiment of the Accessorail System carry bag of the present invention.
FIG. 20C is a bottom view with an embodiment of accessories in an embodiment of the Accessorail System carry bag of the present invention.

In embodiments of the Accessorail System carry bag 212, a small accessory pouch 38 and a medium accessory pouch 39 may be chosen as accessories to be attached to the Accessorail System panel 24. As shown in FIG. 19A, the rear panels 82 and 83 of the small and medium pouches 38 and 39 may have a fabric or other mating material along the surface 60 to be secured to the hook and loop fastener on the surface 58 of the Accessorail System panel 24 as shown in FIG. 19B. As shown in FIG. 19C, the small and medium pouches 38 and 39 may be aligned one above the other by selecting suitable slits 26 within Accessorail System rails 22. The Accessorail System accessories are attached to the Accessorail System panel 24 using the J-hooks 36 as shown in FIG. 19D. A top view of the carry bag 212 with a strap 218 and the small and medium pouch accessories 38 and 39 aligned with the Accessorail System panel 24 is shown in FIG. 20A. A top view showing the small and medium pouch accessories 38 and 39 attached to the Accessorail System carry bag 212 is shown in FIG. 20B and a bottom view of the attachment of the accessories to the Accessorail System carry bag 212 is shown in FIG. 20C.

In addition to the golf bags shown and described herein, the Accessorail System 10 may be incorporated with other types of sports equipment bags including baseball equipment bags, rock climbing, camping or hiking bags and back packs, gym and work out bags and others. The invention has therefore been described in detail with particular reference to certain preferred embodiments thereof, but it will be understood that variations and modifications can be effected within the spirit and scope of the invention.

What is claimed is:

1. An accessory attachment system comprising:

a sports equipment bag formed having a plurality of attachment panels along a front panel, a rear panel, or side panel, the rear panel having a left-side panel and a right-side panel angled outwards and extending at more than 90 degrees from the rear panel;

at least one attachment fixture attached to an accessory of a sports equipment bag;

the plurality of attachment panels having a plurality of slits aligned along a rail of reinforced fabric, the slits extending perpendicularly to the rail of reinforced fabric and configured to accept the at least one attachment fixture; and wherein the accessory may be removably attached to the sports equipment bag by inserting the attachment fixture into at least one of the plurality of slits of one of plurality of attachment panels.

2. The accessory attachment system of claim 1 wherein the attachment fixture comprising a J-hook configured to be inserted in one of the plurality of slits.

3. The accessory attachment system of claim 2 wherein the J-hook comprising a tapered flattened extender extending from a top portion that extends from a back frame with a minimal distance between the extender and back frame to provide for a surface of the accessory adjacent to the attachment panel to lay flat against the attachment panel.

4. The accessory attachment system of claim 3 wherein the back frame of the J-hook having a cross bar forming an opening configured to accept a strap attached to an accessory.

5. The accessory attachment system of claim 1 wherein the attachment panel comprising an outer surface covered with a hook and loop fastener.

6. The accessory attachment system of claim 5 wherein the accessory comprising an outer surface covered with a mating hook and loop fastener for attachment to the attachment panel comprising an outer surface covered with a hook and loop fastener.

7. The accessory attachment system of claim 1 wherein the attachment panel configured to attach a plurality of accessories.

8. The accessory attachment system of claim 1 wherein the sports equipment bag is a golf bag.

9. A golf bag having detachable accessories, comprising:

a golf bag formed having a plurality of attachment panels along a front panel, a rear panel, or side panel, the rear panel having a left-side panel and right-side panel that are angled outwards and extend at more than 90 degrees from the rear panel;

at least one attachment fixture attached to an accessory of a golf bag;

the plurality of attachment panels having a plurality of slits configured to accept the at least one attachment fixture; and wherein an accessory may be removably attached to the golf bag using the attachment fixture and one or more of the plurality of attachment panels.

10. The golf bag having detachable accessories of claim 9 wherein the attachment fixture comprising a J-hook configured to be inserted in one of the plurality of slits.

11. The golf bag having detachable accessories of claim 9 wherein the attachment panel comprising an outer surface covered with a hook and loop fastener.

12. The golf bag having detachable accessories of claim 11 wherein the accessory comprising an outer surface covered with a mating hook and loop fastener for attachment to the attachment panel comprising an outer surface covered with the hook and loop fastener.

13. A method of removably attaching an accessory to a sports equipment bag comprising:

affixing a plurality of attachment panels to a surface of a front panel, a rear panel or side panel of a sports equipment bag;

extending a left-side panel and right-side panel at an angle that is more than 90 degrees from the rear panel;

forming slits in a layered portion of the attachment panel;

removably attaching an accessory having an attachment fixture to the sports equipment bag by inserting the attachment fixture into the slits of the attachment panel.

14. The method of removably attaching an accessory to a sports equipment bag of claim 13 comprising:

covering the outer surface of the attachment panel with a hook and loop fastener;

covering a surface of the accessory with a mating hook and loop fastener; and removably securing the surface of the accessory to the attachment panel using the hook and loop fastener.

* * * * *